US007574962B2

(12) United States Patent
Kling

(10) Patent No.: US 7,574,962 B2
(45) Date of Patent: Aug. 18, 2009

(54) SURFACE-DIMENSIONAL TRACK SYSTEM AND METHODS OF USE THEREOF

(76) Inventor: Daniel Kling, 1142A Old York Rd., Ringoes, NJ (US) 08551

( * ) Notice: Subject to any disclaimer, the term of this patent is extended or adjusted under 35 U.S.C. 154(b) by 828 days.

(21) Appl. No.: 10/969,761

(22) Filed: Oct. 20, 2004

(65) Prior Publication Data

US 2005/0139113 A1 Jun. 30, 2005

Related U.S. Application Data

(60) Provisional application No. 60/512,096, filed on Oct. 20, 2003.

(51) Int. Cl.
*B61B 3/00* (2006.01)
*D04C 3/00* (2006.01)

(52) U.S. Cl. ..... 104/89; 87/33

(58) Field of Classification Search ..... 104/89, 104/90, 91; 87/8–11, 33–36, 51
See application file for complete search history.

(56) References Cited

U.S. PATENT DOCUMENTS 4,243,147 A 1/1981 Twitchell et al.
4,352,330 A 10/1982 Tupper
4,459,916 A 7/1984 Tupper
4,641,757 A 2/1987 Rosendale
4,733,783 A 3/1988 Benedict et al.
5,097,770 A * 3/1992 Miyashita et al. ..... 105/72.2
5,337,647 A * 8/1994 Roberts et al. ..... 87/31
5,392,683 A * 2/1995 Farley ..... 87/8
5,445,282 A 8/1995 Erikkila
5,592,883 A * 1/1997 Andress, III ..... 104/88.03
5,630,349 A * 5/1997 Farley ..... 87/8
6,315,138 B1 11/2001 Dyson
6,598,510 B1 * 7/2003 Kim ..... 87/33

* cited by examiner

*Primary Examiner*—S. Joseph Morano
*Assistant Examiner*—Robert J McCarry Jr

(57) ABSTRACT

A surface-dimensional track having a plurality of rails and a car for use therewith is disclosed. Preferred embodiments of the car include a car carriage for motion along the surface-dimensional track in accordance with a two-dimensional velocity vector. Preferred embodiments of the car also include first driving means for securing the car carriage to the surface-dimensional track while causing a component of the motion of the car carriage in accordance with a first component of the two-dimensional velocity vector. Preferred embodiments of the car also include second driving means for causing a second component of the motion of the car carriage in accordance with a second component of the two-dimensional velocity vector. Additional embodiments of systems, methods and apparatus are disclosed herein.

16 Claims, 21 Drawing Sheets

SURFACE-DIMENSIONAL TRACK SYSTEM AND METHODS OF USE THEREOF

CROSS-REFERENCE TO RELATED APPLICATION

The current application claims the benefit under 35 U.S.C. § 119(e) of U.S. provisional patent application 60/512,096, filed on Oct. 20, 2003, which is hereby incorporated by reference in its entirety for all purposes.

BACKGROUND OF THE INVENTION

1. Field of the Invention

The invention disclosed herein relates generally to a surface-dimensional track system, cars for use therein, and methods of use thereof. More specifically, preferred embodiments of the disclosed invention relate to a track system having one or a plurality of cars stably-mounted thereto that are each freely movable along any track surface path substantially free from collision with each other car or other obstacles on the surface.

2. Description of the Prior Art

Coordinated, independent movement and conveyance is an important aspect of automation in many industries. In automated warehousing, storage, retrieval, case picking, and related fields, prior art systems often allow only limited movement within narrow confines of a fixed track or an open area. However, even when a given track or system is designed to encompass a two-dimensional surface, movement of cars or devices along the track is restricted to segmental motion in combinations of steps in the x and/or y directions. While there has been some research in robotics relating to cars having totally free movement on open floor surfaces, such systems have the disadvantage of being restricted to a floor surface. Known free-roaming robots cannot be utilized for vertical, or wall-hanging applications, and are not usable for ceiling-hanging systems. Moreover, free-standing vehicles do not have as much stability or support from tipping over vehicles attached in some manner to a floor-mounted track system.

Automated ceiling suspended conveyance systems have been disclosed in the past. Examples of industries utilizing automated suspended transport include slaughterhouses for carrying carcasses through the butchering process and, in the retail dry cleaning industry, transport for conveyance of specific items of clothing. Movement in such applications has traditionally been confined within the motion accessible with monorail-type track, where only motion in the forward or backward directions along an axis is possible. Such a design will not allow two or more cars to move independently of one another. The same monorail will not support activities that require cars to navigate around each other for either coordinated and cooperative activities or for separate and independent activity.

What is needed in the art is a system that simultaneously provides for the following: (1) the mounting of the cars or devices to a track to provide stability; (2) the ability of cars to move freely in any direction across a surface formed by the track system; and (3) the ability of the cars to freely navigate about each other without entangling or crashing, such as by local attachment of the cars to the track. However, the known prior art does not include technology that satisfies all three of these objectives. For example, known remote control cars of the prior art are not mounted to the track to provide stability, being only "attached" to the floor by the weight of the cars due to gravity. Monorail and coaster-type conveyance systems are firmly attached to their tracks, however they are limited to motion to essentially linear paths along a single dimension of a surface. Furthermore, gantry cranes and XY tables generally only support one moving object and are not adapted for accommodation of multiple cars that can navigate about each other.

SUMMARY OF THE INVENTION

Preferred embodiments of the invention disclosed herein relate to a single car or a multi-car system, referenced herein as a "surface-dimensional track," where transportation devices, referenced herein as "cars," can be controlled independently to move across a surface defined by the track system to perform automated functions such as material conveyance, complex tooling, winding, braiding, and other functions.

Embodiments of the invention allow a car or cars the freedom to operate simultaneously with other cars and move anywhere along a surface-dimensional track. Embodiments of the present invention also allow cars to avoid one another in separate tasks or to cooperate in coordinated activity without colliding or becoming entangled. Furthermore, the topography of the surface-dimensional track can be of any suitable geometry. For example, the surface-dimensional track can be planar and downwardly facing. The surface-dimensional track can be an inwardly facing surface of a hollow tubular shape.

A surface-dimensional track may include a structure that outlines a continuous surface. For example, while the toothed surfaces of the rails of a track may be spaced apart from one another so that the toothed surfaces form an outline of a continuous surface, the plurality of toothed surfaces, collectively, may be characterized as forming a surface-dimensional track. Preferred embodiments of the surface-dimensional track may be planar, cylindrical, tubular, sinusoidal, parabolic, or have any other suitable topography. Various points of the surface-dimensional track may face in different directions from one another, depending on the topography of the surface-dimensional track. It is also possible to connect regions of the surface-dimensional track directly to sections of linear track.

References made herein to coordinates, e.g., x, y, and z, are being made for the purposes of clarity of disclosure only. For example, a reference to an first component of a two-dimensional velocity vector and a y-component of a two-dimensional velocity vector does not restrict the overall orientation or configuration of the coordinate system being used with the two-dimensional velocity vectors, but rather is being used to indicate a relationship between the two components of said two dimensional velocity vector. It is contemplated that the cars will move tangentially along the surface of the surface-dimensional track. In a preferred embodiment, the car has two motor means for moving in a first direction and a second direction in order to accomplish the desired trajectory along the surface. Embodiments of the surface-dimensional track include planar and non-planar embodiments. Thus, when the surface-dimensional track is planar, the first and second direction components may be, for example, the x and y directions of an absolute coordinate system. In other non-planar embodiments such as a cylindrical surface, the first and second directions will be cylindrical coordinates, for example, θ and z directions of an absolute coordinate system. As used herein, the term "surface" or references to "surface-dimensional" refer to a substantially two-dimensional locus of points, such a planar surface, the curved surfaces of a cylinder or tube, a surface of varied topography, and the like.

In preferred embodiments of the invention, the motion of the car along the surface-dimensional track may be in any direction tangential to the surface of the track. In the case of parallel rails, this may be accomplished by a car that moves both longitudinally along the rails, laterally from rail to rail, or in any trigonometric combination of the two directions. Such motion may achieve any angle or curved path along the surface-dimensional track and is not confined to segmental motion limited only in the X and/or Y directions of conventional cellular track networks. In preferred embodiments of the invention, one or more cars are mounted to the rails to provide stability, the cars may move freely in any direction or trajectory along the surface of the track, and multiple cars may freely navigate along the surface-dimensional track without entangling or crashing with other cars. The cars are preferably locally attached (e.g. mechanically engaged with) to the track having a local footprint. In preferred embodiments of the invention, multiple cars can freely encircle each other while in operation without the components of either car crashing or entangling with the components of the other cars.

There are many varied methods of using the structures disclosed herein. For example, some embodiments of a method of using the surface-dimensional track system may include methods of improving flexibility and capabilities of automated production lines, methods to improve material handling, and methods to enhance material retrieval systems. Additional methods include using the surface-dimensional track system for fiber braiding, electrical winding, automated assembly benches, and complex tooling.

BRIEF DESCRIPTION OF THE DRAWINGS

The accompanying drawings, which are incorporated in and form a part of the specification, illustrate specific embodiments of the present invention and, together with the description serve to explain the principles of the invention. In the drawings.

DETAILED DESCRIPTION OF THE INVENTION

Figure 1A:
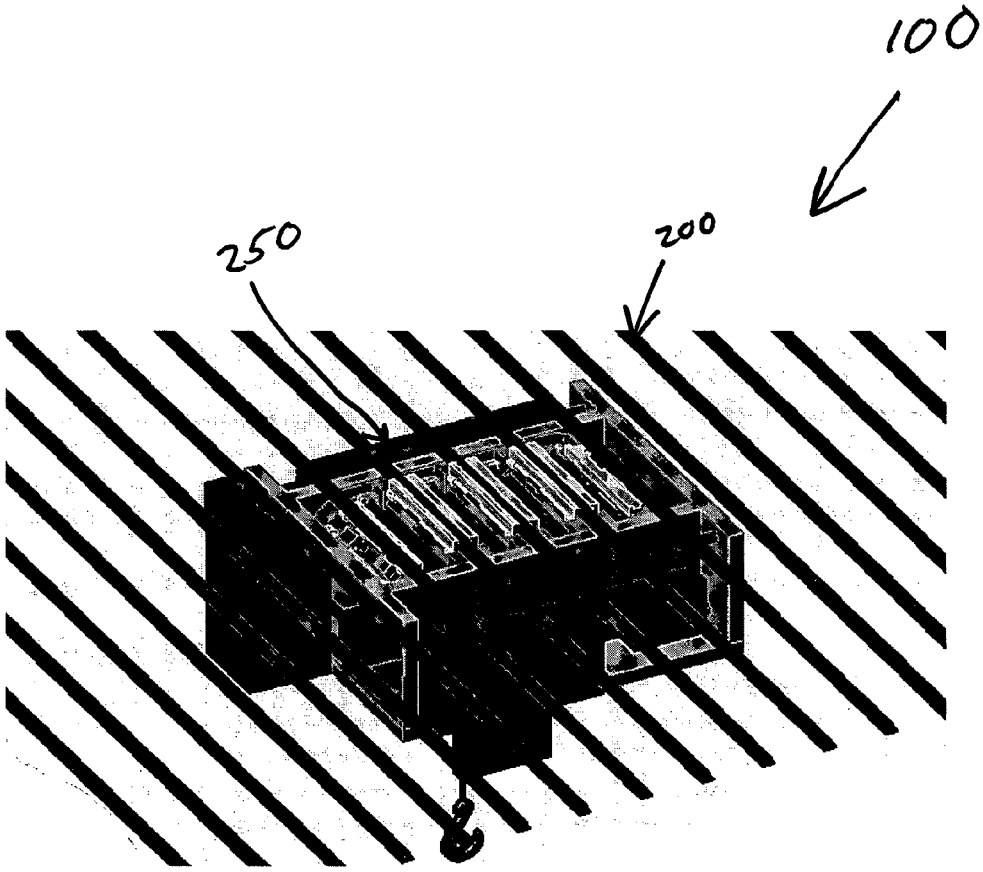
FIG. 1*a* is a perspective view showing an embodiment of a surface-dimensional track system.

In describing a preferred embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Preferred embodiments of the present invention include an automated system that allows separate and independent movement of one or more cars or devices anywhere along any path across a surface-dimensional track, such as a surface or an outline of surface formed by a plurality of rails. In some embodiments of the invention, the surface-dimensional track may be outlined by a grid, parallel tracks, or other surface system, which may be referred to as a track.

The surface-dimensional track may be a single planar area or several different planar areas connected to one another. The cars may be computer-automated and move independently of each other across the surface-dimensional track. The surface-dimensional track system can preferably accommodate different cars moving independently within the system for cooperative and/or independent motion and other activity. Since the cars are not confined to a linear track, the cars may navigate the coordinates of the surface-dimensional track to avoid a collision with another car. The possible uses of the various embodiments of the virtual track system are endless, and include, by way of non-limiting example, factory material handling, warehousing operations, and cargo loading. Embodiments of the surface-dimensional track system can also be used for complex and automatic weaving and/or wire braiding/winding. Embodiments also include automated engagement and/or complex tooling machines for manufacturing processes.

In the surface-dimensional track system of the present invention, the car is secured locally to a track, the track describing a surface of car location points. In preferred embodiments, each car may be assigned a footprint, which is a region on the track surface including the apparatus of the car, its carriage, motors, track-securing mechanisms and other features. The footprint travels on the track surface with the car, and the car may travel along any path of the surface provided the footprint does not move beyond the extents of the surface. Furthermore, obstructions may be added to the track surface, such as functional objects relating to the external environment of the track system, which reduce the area of the operational track surface. The car then may travel along any path on the operational track surface without collision with the obstruction, provided the cars footprint does not extend off the operational track surface and overlap the region occupied on the surface by the obstruction. If multiple cars are on the track, the cars simultaneously may follow any set of prescribed paths without car-to-car induced collision, provided that their respective footprints are distanced to keep from intersecting. For example, taking the radius of the footprint to be the radius of the smallest circle centered on the car and containing the car's footprint, the cars may follow any set of prescribed paths on the operational surface provided the cars maintain a pair-wise distance of more than twice this radius, and that the cars maintain a distance more than this radius from the extents of the operational surface. In preferred embodiments this radius is much smaller than the width of the track surface, and so by observing the radius spacing constraints, multiple cars can freely encircle each other along any simultaneous path program without entangling or crashing equipment or other cars on the track system.

Figure 1B:
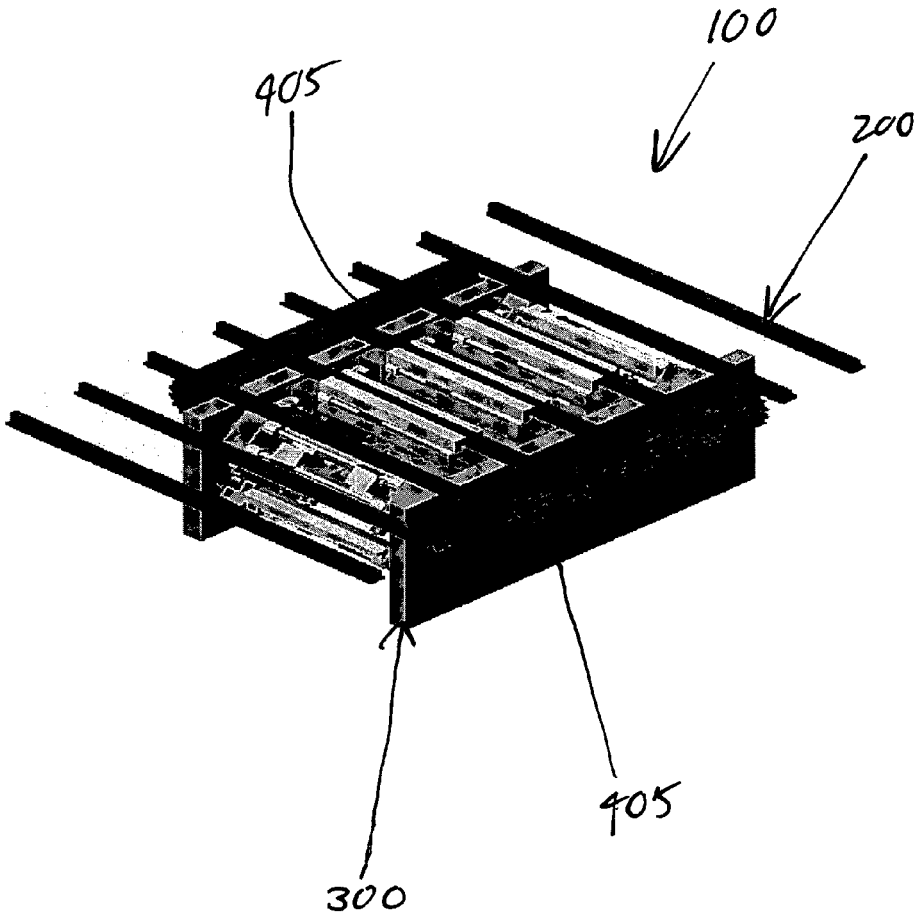
FIG. 1*b* is a perspective view showing an embodiment of the first driving assembly and pinion of the surface-dimensional track system shown in FIG. 1*a;*
Figure 1C:
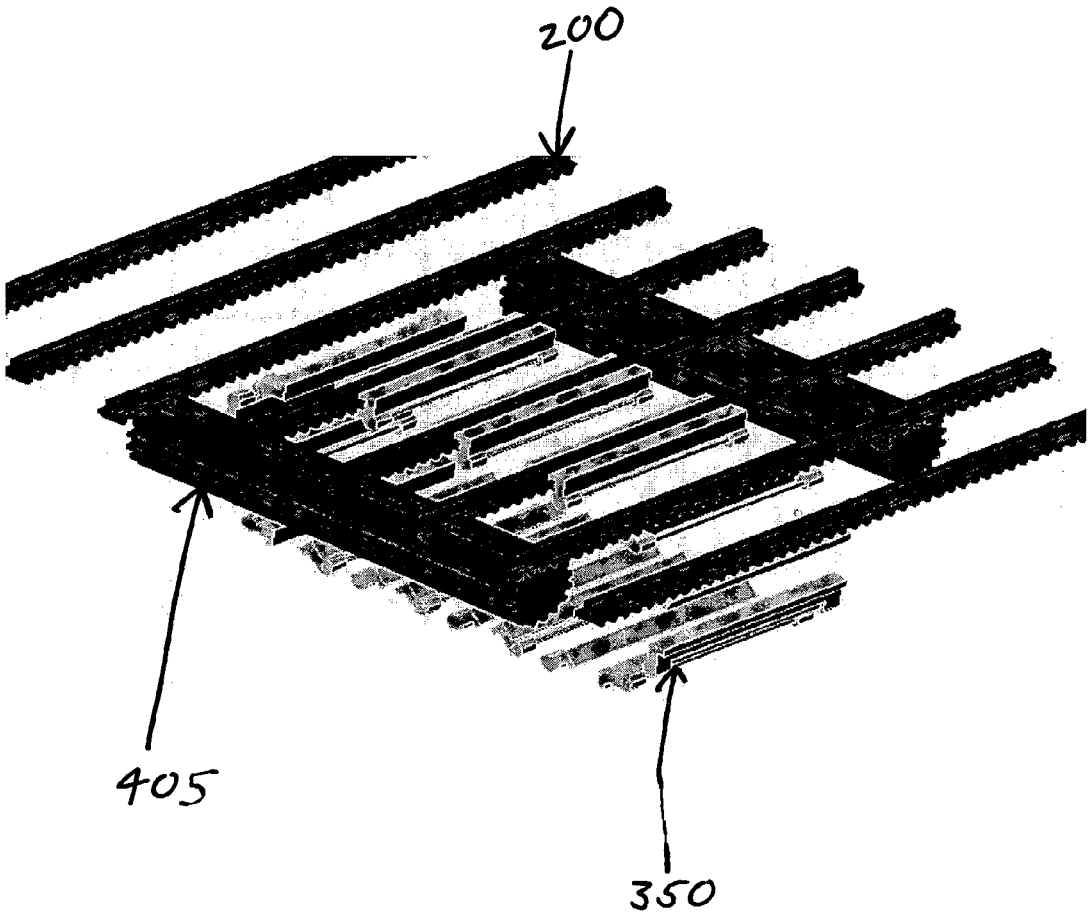
FIG. 1*c* is a perspective view showing an embodiment of the pinion and grippers of the surface-dimensional track system shown in FIG. 1*a;*
Figure 2A:
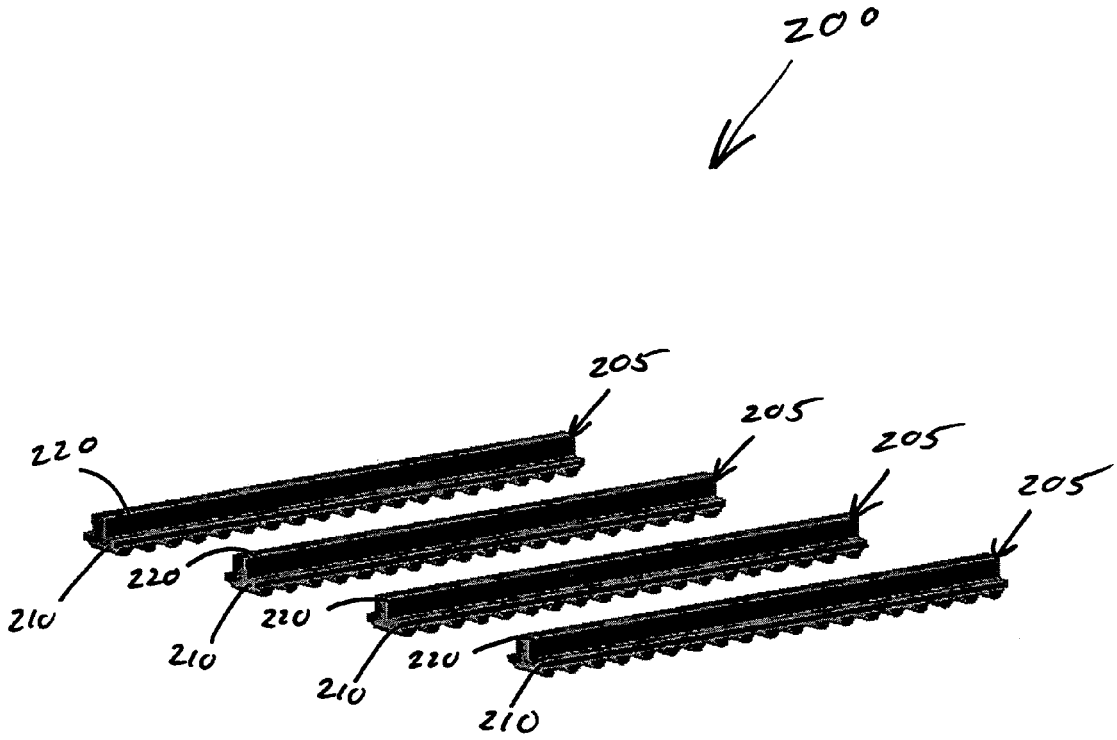
FIG. 2*a* is a perspective view showing an embodiment of a track.
Figure 2B:
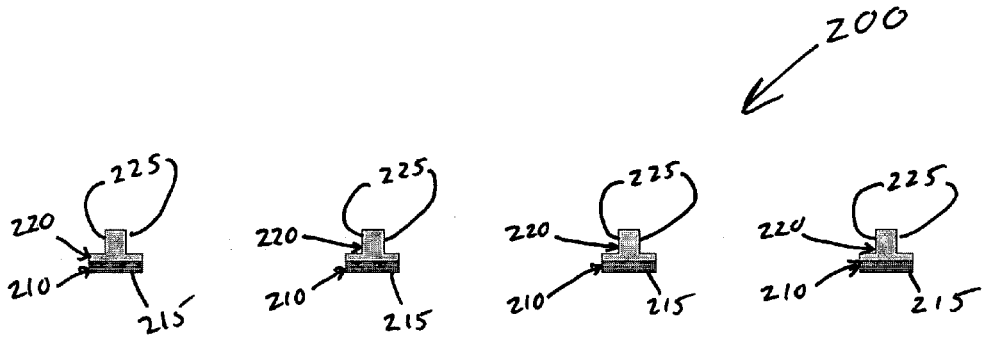
FIG. 2*b* is a left elevational view showing the embodiment of the track shown in FIG. 2*a*, the right elevational view being a mirror image thereof.
Figure 2C:
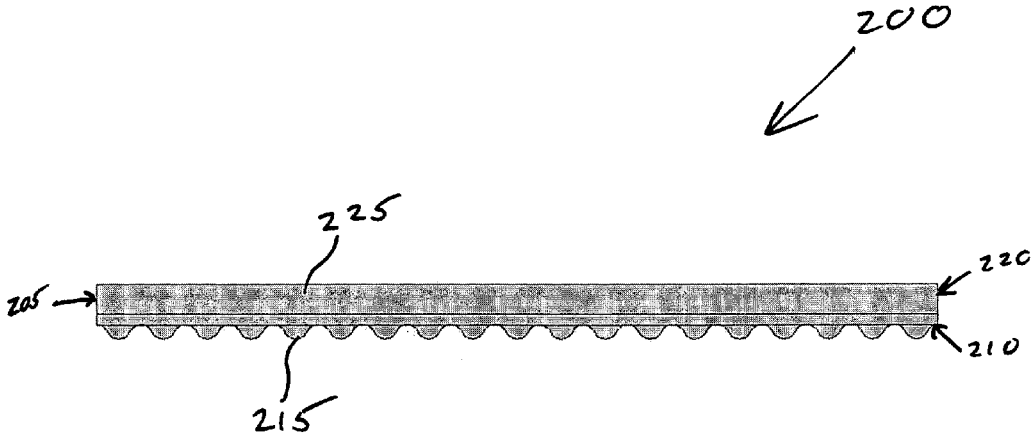
FIG. 2*c* is a front elevational view showing the embodiment of the track shown in FIG. 2*a*, the back elevational view being a mirror image thereof.
Figure 2D:
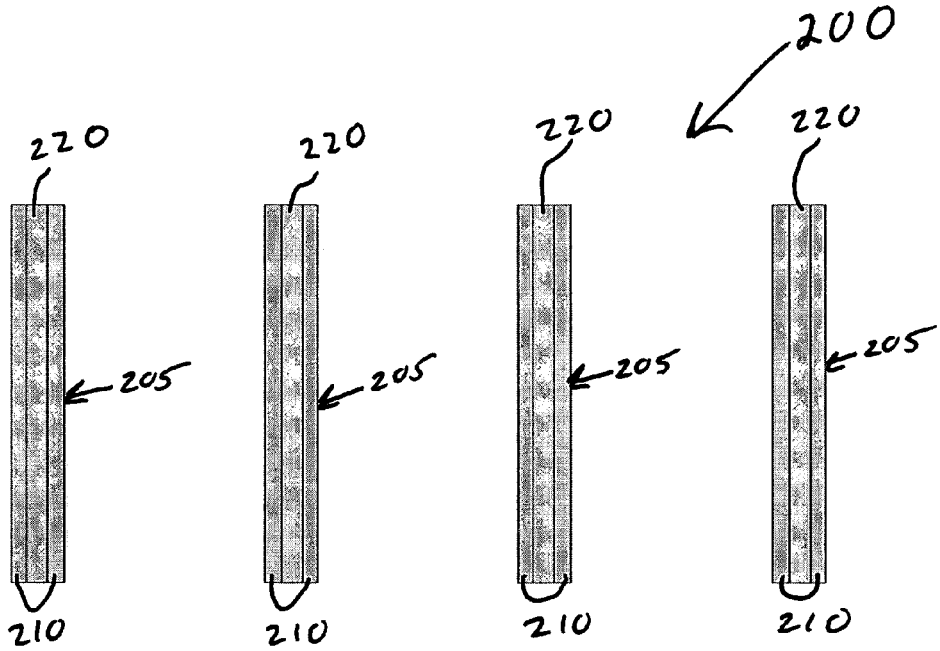
FIG. 2*d* is a top plan view showing the embodiment of the track shown in FIG. 2*a;*
Figure 2E:
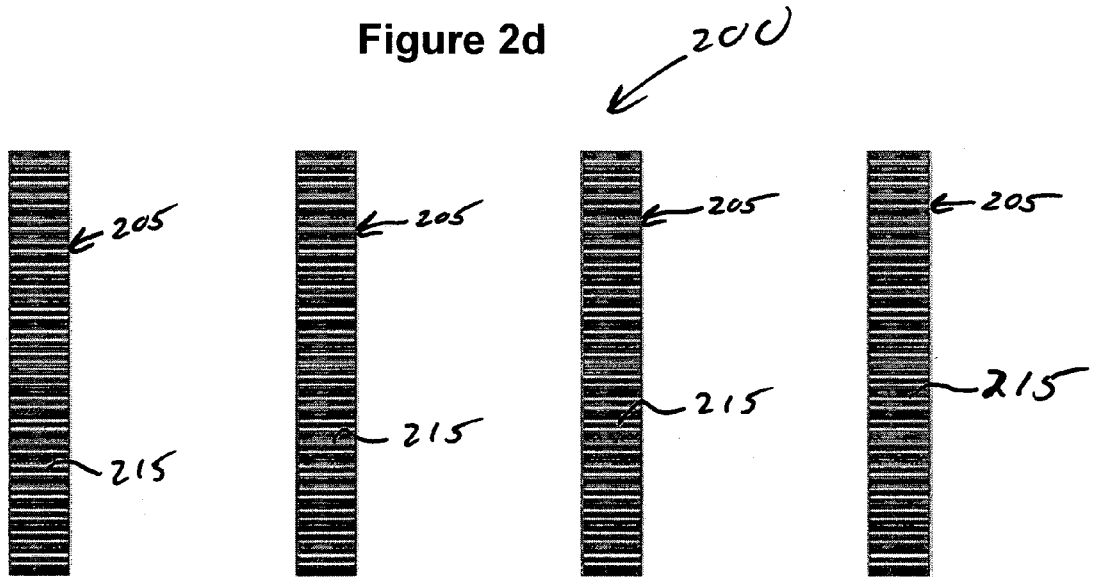
FIG. 2*e* is a bottom plan view showing the embodiment of the track shown in FIG. 2*a;*

With principal reference to FIGS. 1*a*-1*c*, a preferred embodiment of surface-dimensional track system is shown and designated generally as 100. Surface-dimensional track system 100 preferably include a track 200 and a car 250. FIG. 1*a* shows a preferred embodiment of car 250 in conjunction with track 200, while FIG. 1*b* principally shows the first driving assembly 300 and pinion 405 of car 250. FIG. 1*c* is further "stripped-down" in order to illustrate that pinion 405 and grippers 350 are the preferred components of car 250 that mechanically engage track 200 in order to induce the motion in accordance with a first component and a second component of the two-dimensional velocity vector. Any other suitable means may be used for inducing the first component and/or second component of the two-dimensional velocity vector.

With principal reference to FIGS. 2*a*-2*e*, an embodiment of track 200 will now be discussed in further detail. Track 200 preferably includes a plurality of rails, such as T-rails 205. Although any suitable rail may be used in track 200, T-rails 205 (shown), J-rails, and I-rails are preferred and the rails are herein referenced as T-rails 205 for the purpose of clarity. Each of T-rails 205 include a head portion 210 and a carriage portion 220. Head portion 210 is preferably downwardly-facing in a ceiling-mounted track 200 forming a planar surface-dimensional track. Preferred embodiments of track 200 include at least four T-rails 205.

Each T-rail 205 preferably include a toothed surface 215 on head portion 210. Each toothed surface 215 is preferably positioned substantially parallel to each other toothed surface 215, so as to facilitate the lateral engagement of the pinions 405 (although some embodiment of track 200 may include a grid or other construction generating a surface-dimensional track). Each of toothed surfaces 215 preferably comprise teeth transversely positioned along T-rail 205. Some embodiments of track 200 include teeth comprising bearings to lesson the friction of pinion 405. In preferred embodiments of track 200, toothed surfaces 215 collectively form a topographical outline of a continuous surface, which is referenced herein as a "surface-dimensional track." The surface-dimensional track may be planar, such as that shown in FIGS. 2*a*-2*e*, or as discussed further below with principal reference to FIG. 7, the surface-dimensional track may be substantially annular. Any suitable topography for the surface-dimensional track can be used. It is contemplated that embodiments of surface-dimensional track may have a double curvature.

Each T-rail 205 preferably includes a gripping surface set 225 on or near the carriage portion 220. Each surface of a given gripping surface set 225 is preferably parallel with each other surface of the given gripping surface set 225 to facilitate engagement with grippers 350 of car 250, which is discussed further below. Each gripping surface set 225 preferably includes a positive electrical point and a negative electrical point (not shown) for conducting electricity to car 250 from a power source (not shown). In various preferred embodiments the required electrical polarities may be located on opposite sides of the T-rails, at different elevations on the body of the T-rails, in alternating sequences of T-rails, and/or any combination of these and other locational options for interspersing the required polarities across the track system to supply power to the car. In preferred embodiments of surface-dimensional track system 100, track 200 comprises parallel T-rails 205 extending in a direction of a plane. Track 200 can be mounted on any suitable surface, including a floor, wall, or ceiling.

Preferred embodiments of car 250 will now be discussed. Preferred embodiments of car 250, such as car 250 shown in FIGS. 5*a*-5*d*, includes an first driving assembly 300, a second driving assembly 400 and a car carriage 500. Some embodiments of car 250 include an auxiliary assembly 600, and receiving means, such as receiver assembly 700. Cars 250 preferably roll along a given set of T-rails 205, mechanically engage new T-rails 205 to move sideways, or move in any angular combination of these two directions. Track 200 preferably supplies electric power, rigidity, and location indexing for cars 250. The cars are preferably linked to a central computer of a remote control system, either through receiver assembly 700, connections through the track, etc.

Figure 3:
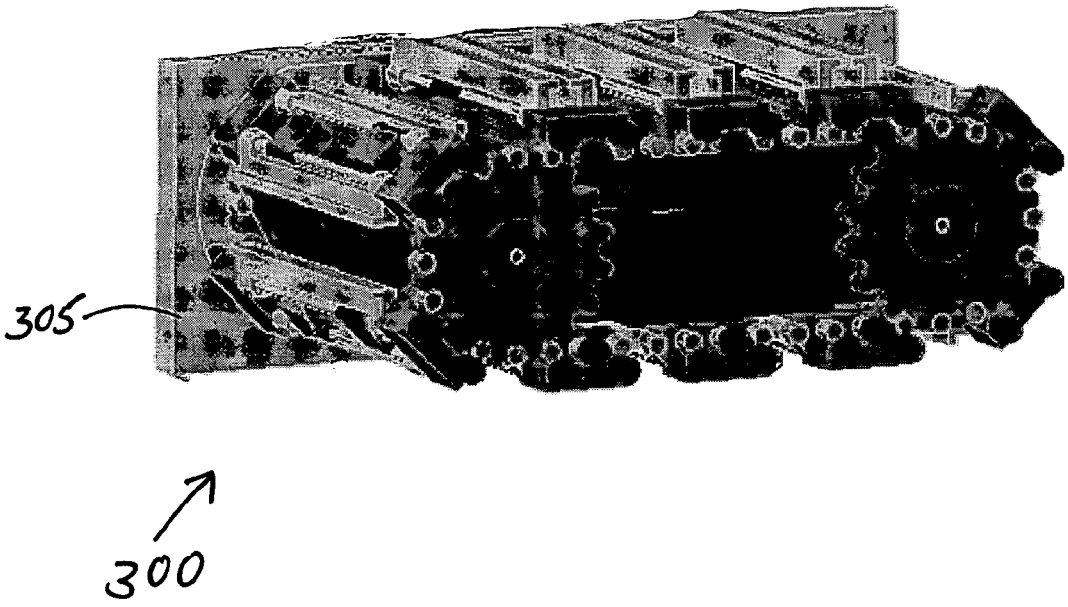
FIG. 3 is a perspective view showing an embodiment of an first driving assembly with one of the two side cam plates being removed therefrom.

With principal reference to FIGS. 3 and 4*a*-4*f*, a preferred embodiment of first driving assembly means, referenced herein as first driving assembly 300, is shown and will now be discussed. Preferred embodiments of first driving assembly 300 include two side cam plates 305, one on each side of first driving assembly 300. For the purposes of clarity, FIG. 3 shows first driving assembly 300 to have one of the two side cam plates 305 removed.

The preferred embodiment of First driving assembly 300 includes numerous components and said components will be described with principal reference to FIGS. 4*a*-4*f*. First driving assembly 300 preferably includes sprockets 310, sprocket shafts (not shown), grippers 350 and a chain assembly (not numbered). Preferred embodiments of the chain assembly include two side cam plates 305, each having a slide cam plate groove 307, side cam followers 315, a chain 320, end blocks 325, slider rods 330, slider blocks 335, central cam followers 340, a central cam plate 345, central cam plate grooves 347 and sleeves 360. Any suitable chain assembly known in the art can be used. A chain assembly, rather than just chain 320, is preferred to maintain the tension of chain 320 when grabbers 350 engage T-rails 205.

For the purposes of clarity, not every component is marked with a reference character in FIGS. 4*a*-4*f*. Instead, each of FIGS. 4*a*-4*f* are successively referenced to discuss the various structural layers of the preferred embodiment of first driving assembly 300. The preferred components of first driving assembly 300 will now be discussed in turn with principal reference to FIGS. 4*a*-4*f*. As discussed below, preferred embodiments of first driving assembly 300 utilize symmetrical structures in numerous places.

Figure 4A:
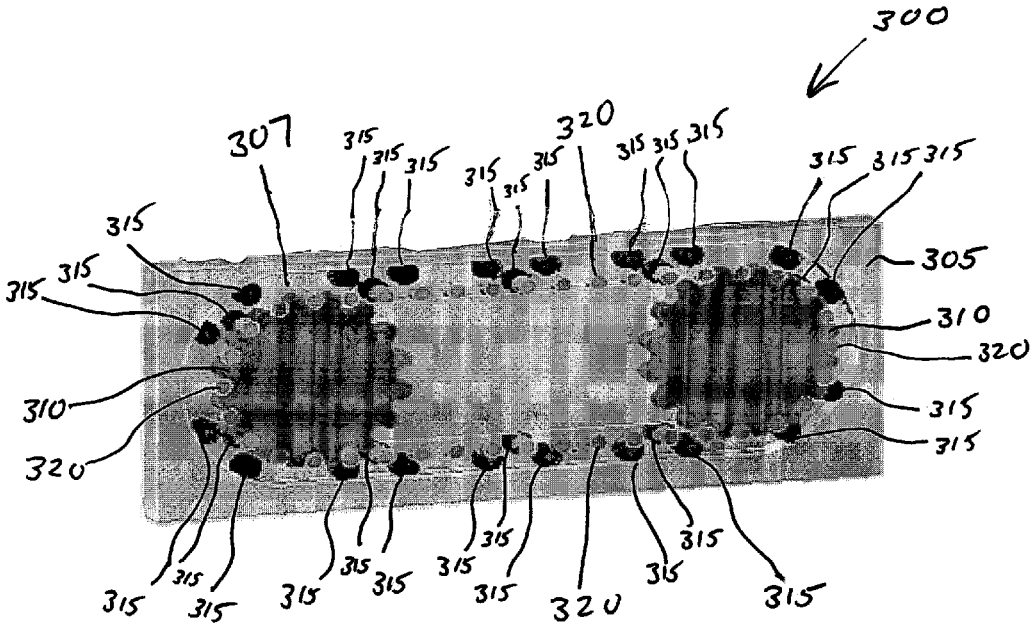
FIG. 4*a* is a partial view of the first driving assembly shown in FIG. 3, with a side cam plate, a side cam plate groove, side cam followers, sprockets, and a chain being shown.
Figure 4B:
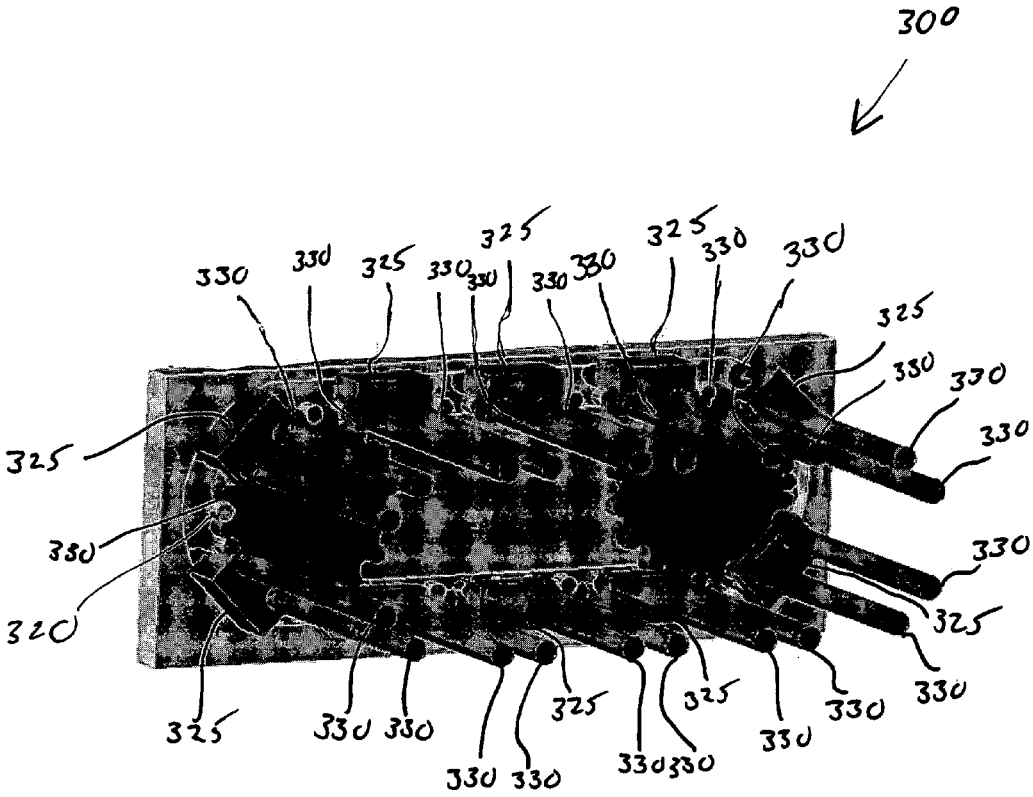
FIG. 4*b* is a partial view of the first driving assembly shown in FIG. 3, with end blocks and slider rods being shown.

With principal reference to FIG. 4*a*, first driving assembly 300 includes a side cam plate 305. A groove, referenced herein as side cam plate groove 307, follows the perimeter of side cam plate 305 in an oval-like path. At least two sprockets 310 are connected to side cam plate 305 via sprocket shafts, which each extend from one side cam plate 305 to the other side cam plate (not shown in FIG. 4*a*). A chain 320 is wrapped about sprockets 310. Sets of three side cam followers 315 are positioned about side cam plate groove 307 for motion along side cam plate groove 307. With principal reference to FIG. 4*b*, end blocks 325 each attach to a set of three side cam followers 315 and operatively rest upon chain 320. A pair of slider rods 330 extend from each end block 325. First driving assembly 300 is preferably symmetrical and additional end blocks 325 attach to both ends of each set of slider rods 330 and said end blocks 325 attach to another side cam plate 305 via additional side cam followers 315.

Figure 4C:
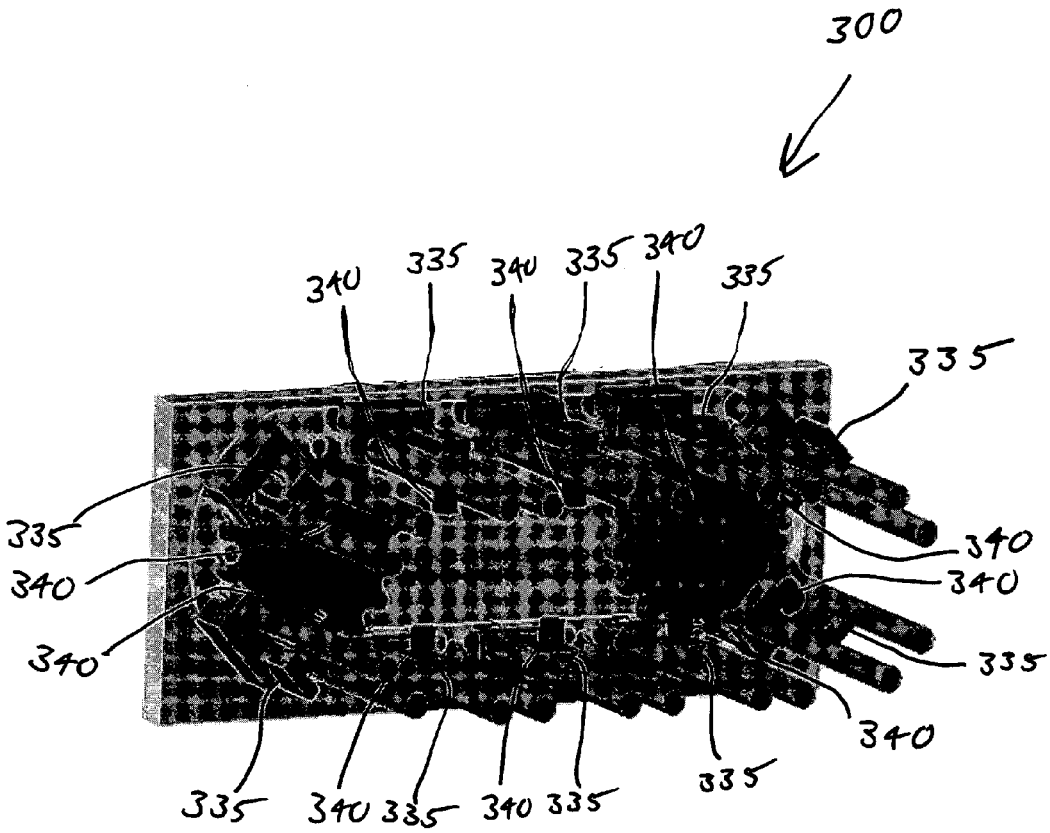
FIG. 4*c* is a partial view of the first driving assembly shown in FIG. 3, with slide blocks and central cam followers being shown.
Figure 4D:
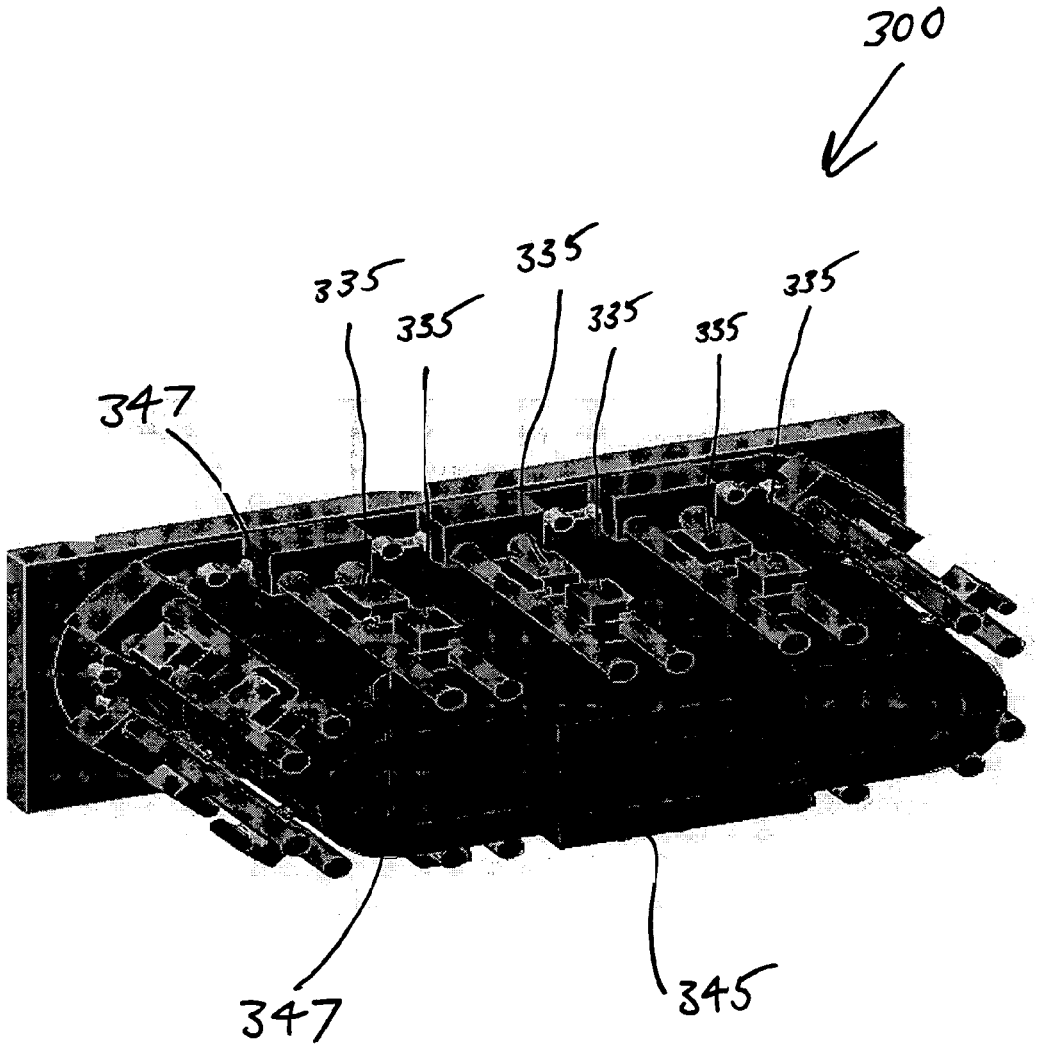
FIG. 4*d* is a partial view of the first driving assembly shown in FIG. 3, with slide blocks, a central cam plate, and central cam plate grooves being shown.

With principal reference to FIG. 4*c*-*d*, slider blocks 335 are securely seated on each pair of slider rods 330 and a central cam follower 340 extends inwardly from each slider block 335. As shown in FIG. 4*c*, a single slider block 335 may be used for each pair of slider rods 330, however as shown in FIG. 4*d*, it is preferred that two slider blocks 335 be used for each pair of slider rods 330. As shown in FIG. 4*d*, a central cam plate 345 is positioned within first driving assembly 300 with two central cam plate grooves 347 to match the two slider blocks 335 per pair of slider rods 330. In preferred embodiments, central cam plate grooves 347 are closer to one another towards the portion of central cam plate 345 that are nearest track 200 and farther from one another along other portions of central cam plate 345. In embodiments of first driving assembly 300 having one slider block 335 per pair of slider rods 330, central cam plate 345 contains a single central cam plate groove 347 preferably following a similar path as that for one of central cam plate grooves 347 shown in FIG. 4*d*.

Figure 4E:
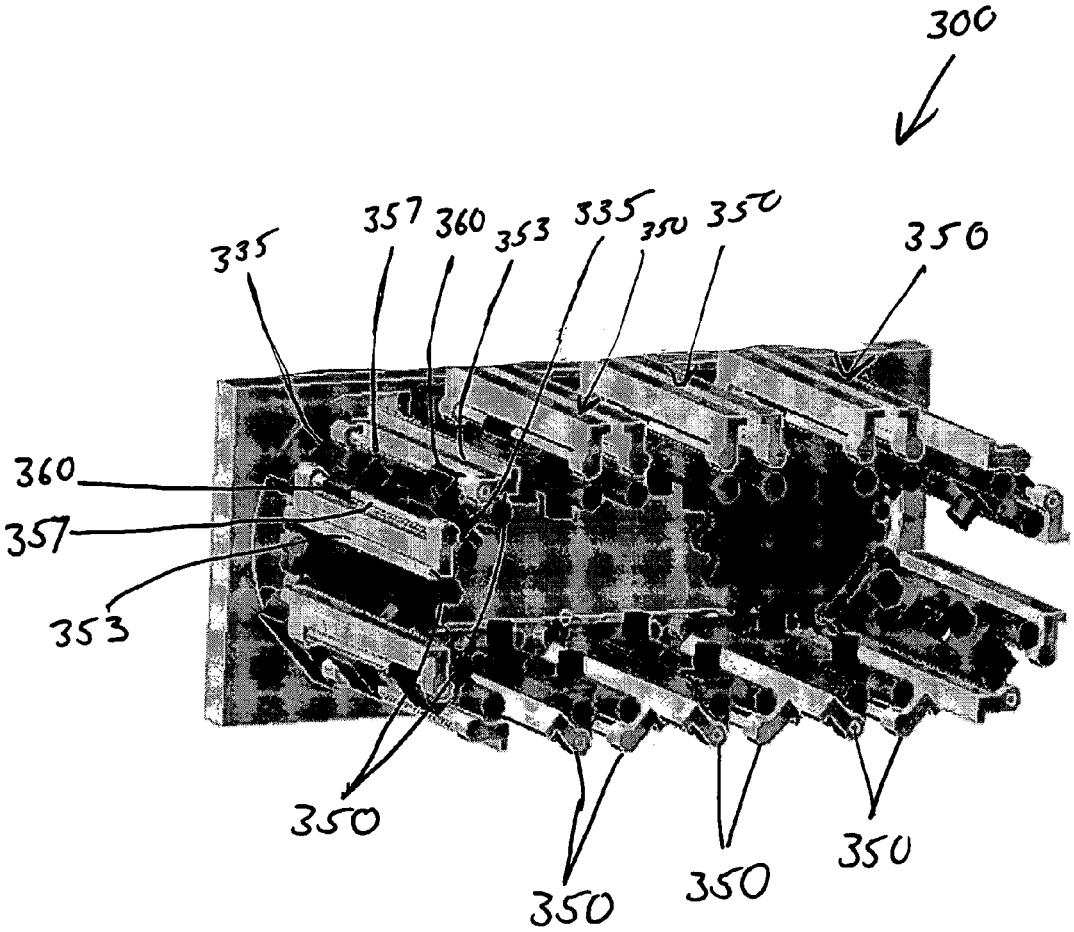
FIG. 4*e* is a partial view of the first driving assembly shown in FIG. 3, with grippers, slider blocks and sleeves being shown.

With principal reference to FIG. 4*e*, first driving assembly 300 includes a plurality of grippers 350, which each include a set of gripper sides 353 and a corresponding set of gripper shafts 357. First driving assembly 300 also includes sleeves 360, which are preferably helical. Grippers 350 rotate rigidly with their gripper shafts 357 along the axis of their gripper shaft 357 which is securely seated within each pair of slider blocks 335. Gripper shafts 357 of each gripper 350 are securely engaged with corresponding slider blocks 335 via sleeves 360. Grippers shafts 357 preferably include a helical gear (not shown) to match sleeve 360.

Figure 4F:
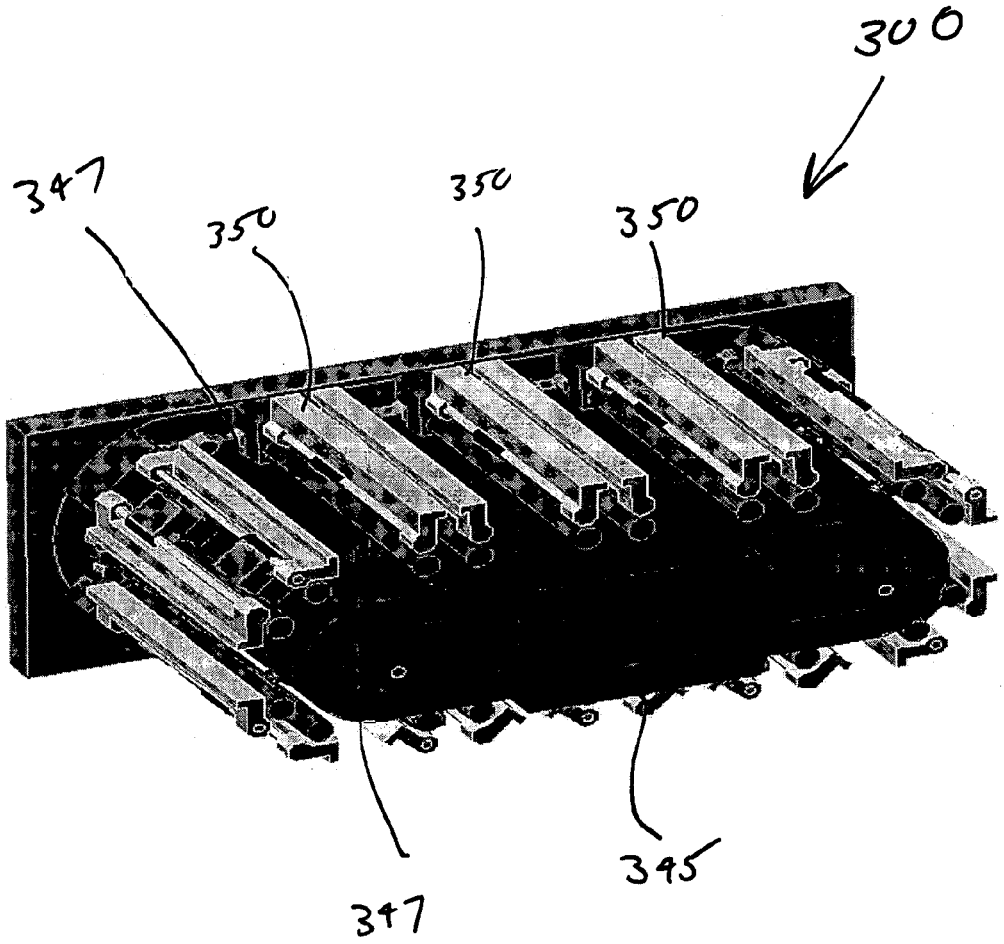
FIG. 4*f* is a partial view of the first driving assembly shown in FIGS. 3 and 4*e*, with grippers, slider blocks and sleeves being shown with a central cam plate.

As shown in FIG. 4*f*, grippers 350 are in an open position as each of central cam plate grooves 347 are nearest to one another and in a closed position as each of central cam plate grooves 347 are farthest from one another. In preferred embodiments of first driving assembly 300, bearings, wheels and/or other components may be included near the ends of grippers 350 to minimize friction with T-rails 205 and to facilitate rolling on head portion 210 of T-rail 205. In some embodiments, said wheels may be motorized to provide motion in the second direction. The total articulation of the gripper may be approximately one hundred and twenty degrees, thus sleeve 360 preferably turns slowly. This enables the easy control of the position of central cam followers 340, in turn allowing precise and firm control of the closing angle of grippers 350.

Continuing with principal reference to FIG. 5*a*-5*d*, preferred embodiments of first driving assembly 300 include sprocket gear box 365, sprocket motor 370, and sprocket motor shaft 375 on the outside of one of the two side cam plates 305. Sprocket motor 370 engages sprocket motor shaft 375, which in turn engages components of sprocket gear box 365. Sprocket gear box 365 engages at least one sprocket 310 via suitable structures known in the art.

Preferred embodiments of car 250 further include second driving assembly 400 or other suitable second driving assembly means. Preferred embodiments of second driving assembly 400 include at least one pinion 405 preferably characterized as being spline-like. However, in preferred embodiments of the invention, any pinion suitable for engaging the toothed surfaces 215 may be used. Preferred embodiments of second driving assembly 400 include a pinion motor 420, at least one pinion gear box 415 and at least one pinion shaft 410. Pinion motor 420 engages each of the pinion shafts 410, which in turn engage each of the pinion gear boxes 415. Pinions 405 are preferably engaged by pinion gear boxes 415 via suitable structures known in the art. Pinion 405 is preferably characterized as being a substantially cylindrical pinion.

Figure 5A:
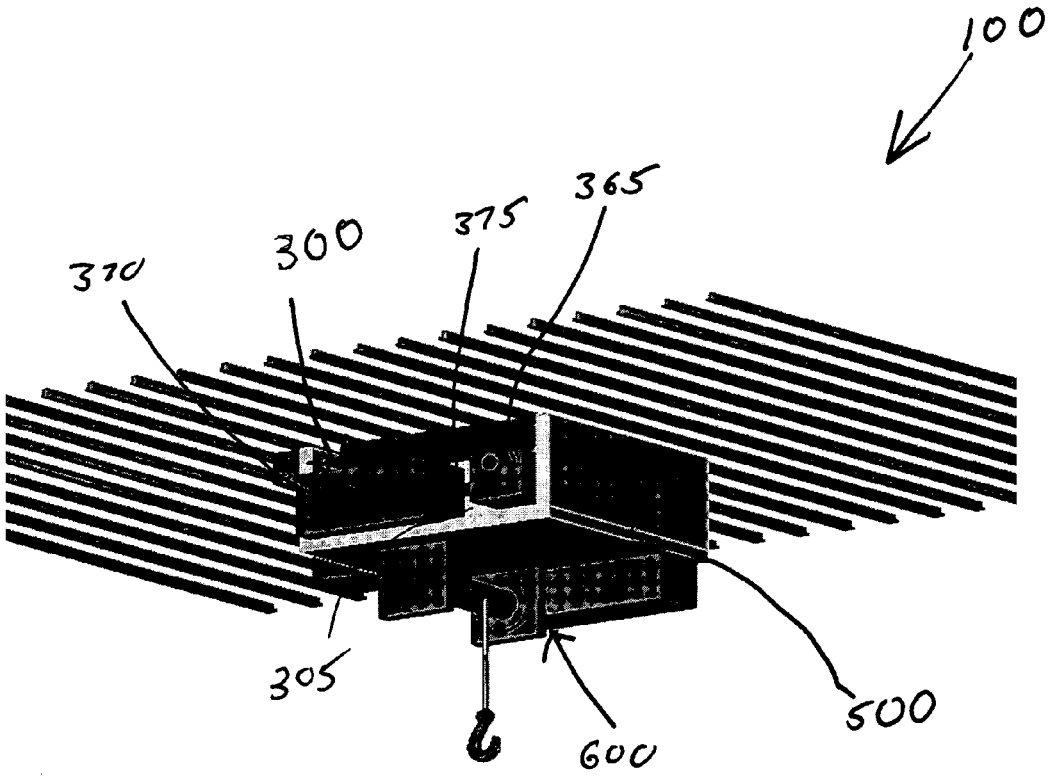
FIG. 5*a* is a perspective view of the embodiment of the surface-dimensional track system shown in FIG. 1, with embodiments of a sprocket gear box, sprocket motor, sprocket motor shaft, car carriage, and auxiliary assembly being shown.
Figure 5B:
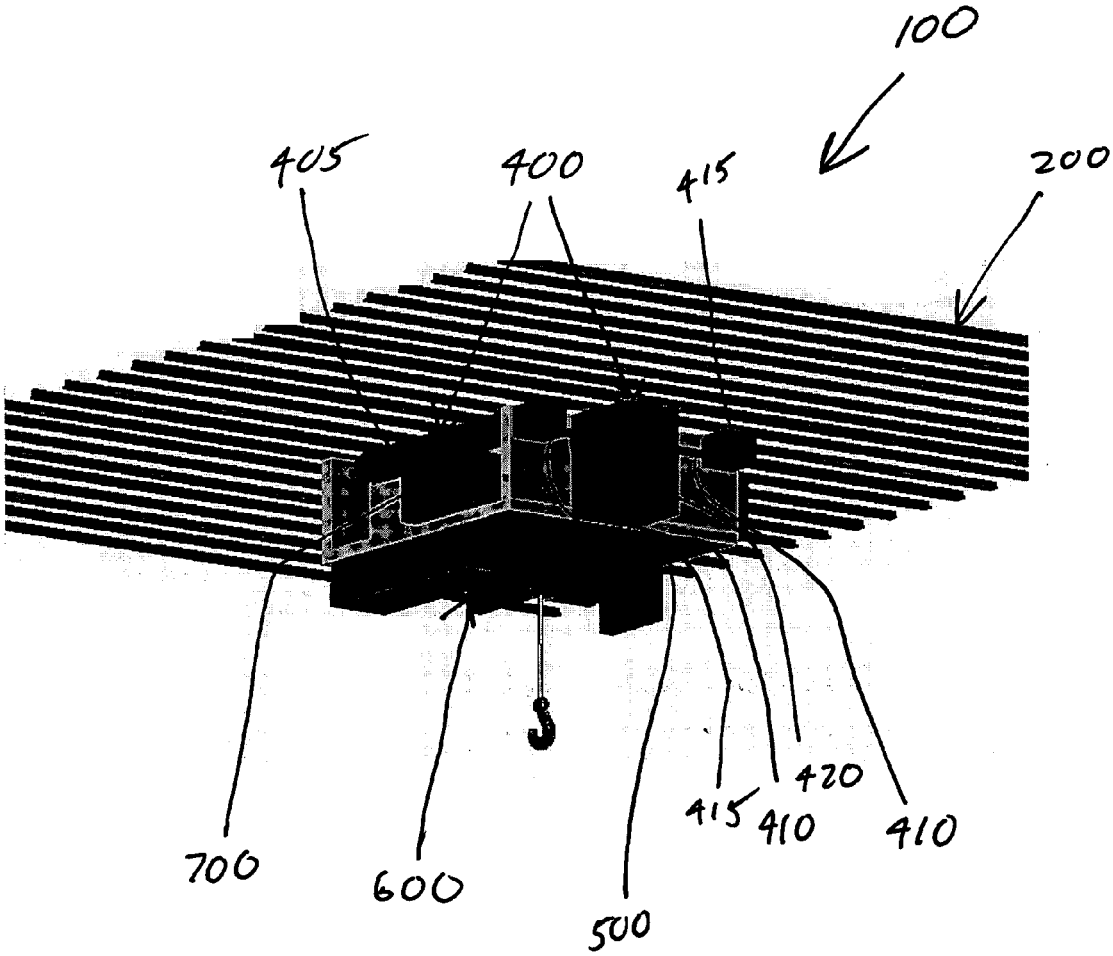
FIG. 5*b* is a perspective view of the embodiment of the surface-dimensional track system shown in FIG. 1, with embodiments of the second driving assembly, auxiliary assembly and receiving means being shown.
Figure 5C:
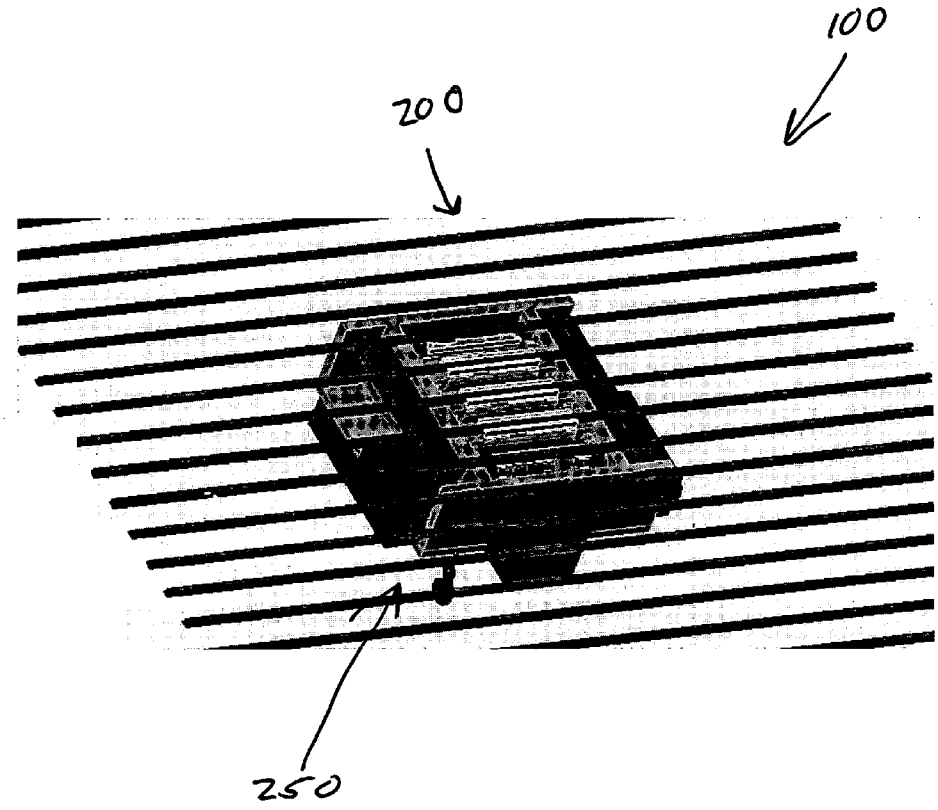
FIG. 5*c* is another perspective view of the embodiment of the surface-dimensional track system shown in FIG. 1.
Figure 5D:
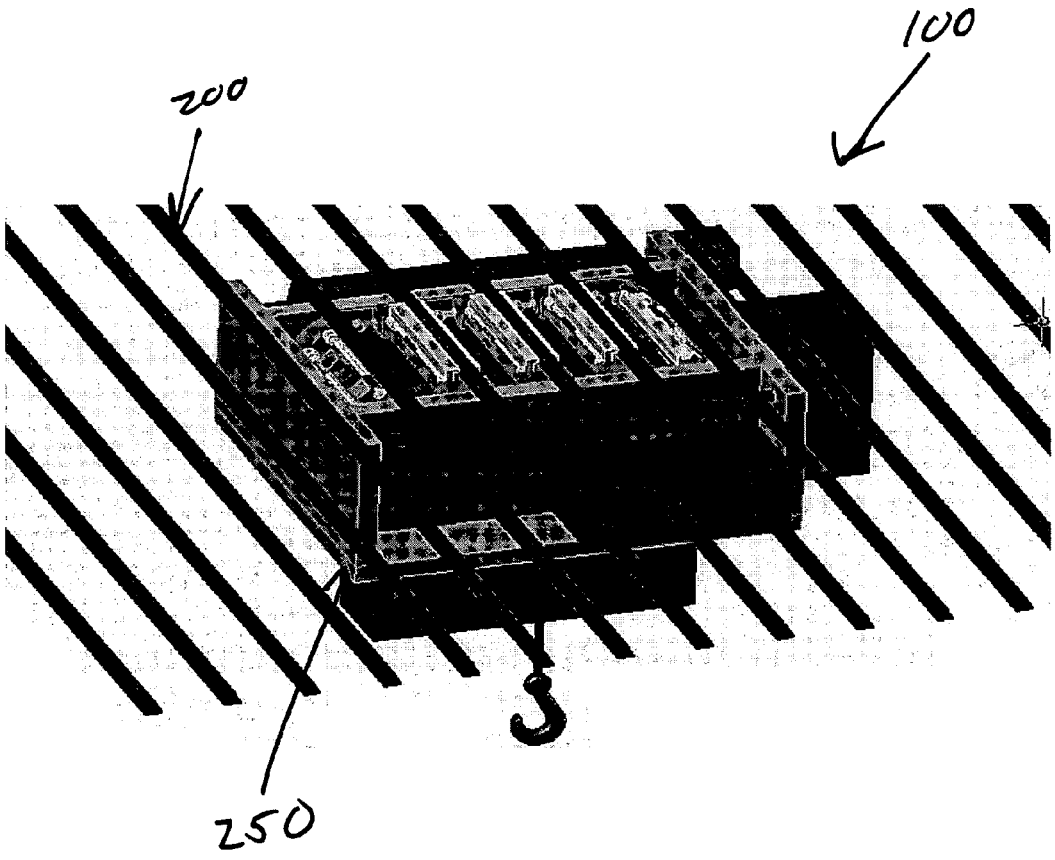
FIG. 5*d* is yet another perspective view of the embodiment of the surface-dimensional track system shown in FIG. 1.

With principal reference to FIGS. 5*a*-5*d*, car 250 preferably also includes a car carriage 500, an auxiliary assembly 600, and receiving means, such as receiver assembly 700. Any suitable structure may be used as car carriage 500, which is shown in FIGS. 5*a* and 5*b* to include a simple housing covering the underside of first driving assembly 300. Preferred embodiments of car carriage 500 may support a payload, support an assembly, such as auxiliary assembly 600, or support any other desired structure. Auxiliary assembly 600 is shown to include a winch assembly, however any suitable auxiliary assembly 600 can be used. By way of non-limiting example, auxiliary assembly 600 can include a robotic arm assembly, a bobbin assembly (see below), a hydraulic assembly, etc. Preferred embodiments of auxiliary assembly 600 are motorized and can receive instructions from the remote control system via receiving assembly 700, discussed below.

Car 250 preferably also includes receiver assembly 700, which preferably includes an antenna and electronic components for wirelessly receiving navigational instructions from a remote control system. Such navigational instructions may include a first component and a second component of a desired two-dimensional velocity vector. Surface-dimensional track system 100 preferably further includes any suitable electrical system known in the art. By way of non-limiting example, T-bars 205 may power car 250 via grippers 350. Suitable methods of powering car 250 are known in the art. Some embodiments of receiving assembly 700 include a transceiver, allowing information to be transmitted from car 250. In some embodiments, information can be transmitted between cars 250. In some embodiments, information can be transmitted from and/or to the cars through electrical contacts on the track.

Figure 6:
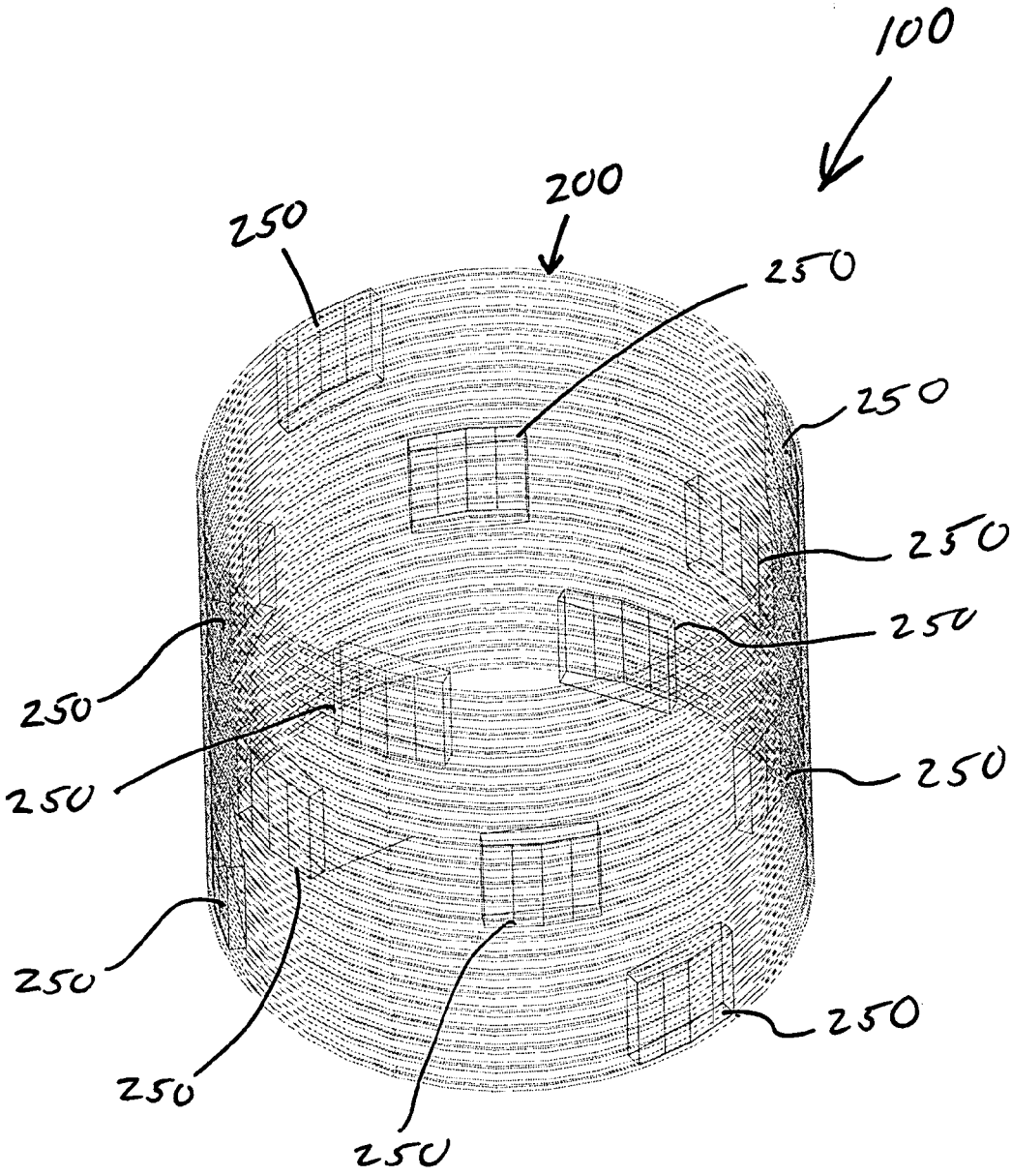
FIG. 6 is a perspective view showing another embodiment of the surface-dimensional track system.

Preferred embodiments of cars 250 mechanically engages track 200 via grippers 350 and pinion 405. Track 200 may be planar or non-planar. As shown in FIG. 6, track 200 may be substantially cylindrical tube. Surface-dimensional track system 100 preferably include a remote control system having a wireless transmitter, a computer-readable medium having computer-executable instructions stored thereon, and at least one computing device for executing the computer-executable instructions. The computer-executable instructions preferably include shortest path software, avoidance software, or other software suitable to the desired application of surface-dimensional track system 100. The remote control system preferably analyzes the topography of track 200 (e.g. planar, annular, etc.) and computes a two-dimensional velocity vector based on the topography of track 200, the position of cars 250 on track 200 and the desired location of cars 250 on track 200. The two-dimensional velocity vector can be transmitted to receiver assembly 700 for conversion into an first component and a second component or conversion can occur at the remote control system and each of the components can be transmitted to receiving assembly 700. The first component of the two-dimensional velocity vector is preferably used to control the rotation of sprocket motor 370 and the second component of the two-dimensional velocity vector is preferably used to control the rotation of pinion motor 420. Various methods of using surface-dimensional track system 100 will now be further described.

Example 1

Ceiling-Suspended Track

Surface-dimensional track system 100 may be planar, preferably comprising many parallel inverted T-rails 205 extending in a second direction and evenly spaced in the first direction. First driving assembly 300 hangs underneath track 200, spanning several T-rails 205. Grippers 350 close on oncoming T-rails 205 and release as grippers 350 roll off T-rails 205. Motion in the second direction is provided by the rack and pinion type mechanism of toothed surfaces 215 and pinions 405. To enable motion in the second direction, grippers 250 preferably include bearings that roll on head portion 210 of inverted T-rails 205. On both sides of first driving assembly 300, there is preferably a long spline gear or other pinion 405 that spans and engages several of toothed surfaces 215, which collectively form a surface-dimensional track. The teeth of successive T-rails 205 are preferably all parallel, enabling pinion 405 to engage toothed surfaces 215 of T-rails 205 as car 250 moves in the second direction.

First driving assembly 300 preferably facilitates motion along an first direction of the surface-dimensional track and second driving assembly 400 preferably facilitates motion along a y direction of the surface-dimensional track. In preferred embodiments of the invention, the x motion and y motion are entirely independent of each other, and thus diagonal velocities can be produced by a vector sum of the first component and second component of a two-dimensional velocity vector. Any straight or curved path may be achieved by control of a plurality of two-dimensional velocity vectors, that are each associated with various velocities along a curved path.

Electric power may be supplied to cars 250 from track 200 in many ways. For example, grippers 250 can be given sliding contact pads or brushes, each contacting a different surface of gripping surface set 225 having different polarities. Pinion 405 is preferably neutral and toothed surfaces 215 of T-rails 205 are preferably grounded. Car 250 preferably includes a housing-type car carriage 500 for holding desired accessories. Car 250 preferably includes auxiliary assembly 600 that can be motorized and controlled by the remote control system. For example, auxiliary assembly 600 could consist of hooks that lower and raise payload, providing additional control in a z-direction. Cars 250 preferably move overhead, away from collisions and are fully location indexed. Cars 250 can preferably move in any direction and can operate simultaneously in any number. A remote control system preferably controls inventory and may provide a scheduling system.

Example 2

Tubular Track

With principal reference to FIG. 6, the surface-dimensional track may be shaped to be substantially annular about a central vertical axis (e.g. cylindrical or tubular). For example, as shown in FIG. 6, track 200 may comprise large circular rails with inside teeth, spaced apart evenly and vertically over each other. Cars 250 may be placed inside the substantially tubular surface-dimensional track, with pinions 405 and other components of second driving assembly 400 causing annular motion and grippers 350 rolling up the surface-dimensional track. T-rails 205 are shown in FIG. 6 to be substantially annular, however, each of T-rails 205 may run vertically, and in some embodiments, have toothed surfaces 215 with a slight arc and grippers 350 to match the arc. With a raw product, for example, suspended in the center of the tube, cars 250 can access the raw product in almost any direction and perform machining operations. Additional auxiliary components may supply radial motion. Potential applications can include winding geometries on the raw product with spools outfitted on the cars. The components of auxiliary assembly 600 are chosen accordingly to suit the desired application of surface-dimensional track system 100.

Example 3

Composite Fiber Braiding

Figure 7:
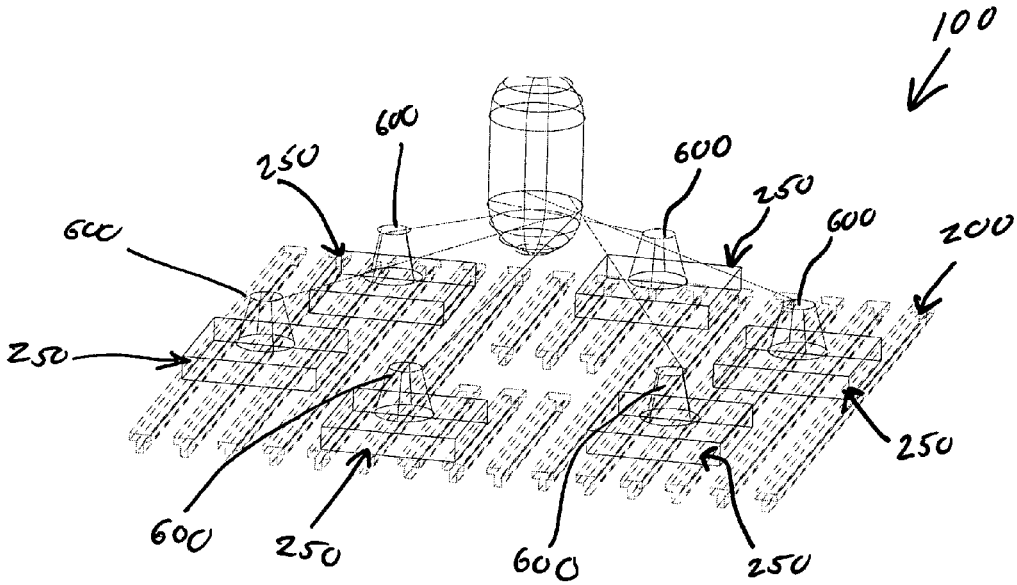
FIG. 7 is a perspective view showing a method of using the surface-dimensional track system.

Referring to FIG. 7, surface-dimensional track system 100 may be used in a method of composite fiber braiding. As shown, auxiliary assembly 600 includes a bobbin. Composite fibers are often wound or braided onto components to strengthen them and a braiding mechanism similar to a "May Pole" may be used, with auxiliary assemblies 600 (bobbins) following weaving paths around a central component (the May Pole) on which the fiber is braided. Of central importance are the angle of attack of the thread on the work piece, and thus the position of the bobbin. For braiding, complex machines of the prior art have been devised to move the bobbins, however mechanical failure and maintenance of the complex machines appears to halt production and each machine generally produces one braid pattern. The present invention avoids said mechanical failures of the prior art and is easily and precisely programmed for various braid patterns.

A horizontal track 200, with cars 250 outfitted with bobbins may produce braids with closer tolerances. The bobbin path along track 200 are smoother and directly controlled. Threads or other fiber can be added simply by feeding new cars 250 into the braiding area. With accompanying software, preferably at a remote control system, the braid design may be changed to suit desired features, such as the wrapping of braid ends. Cars 250 can include electrical motors and sensors to precisely control the tension and, if desired, the z-positions of the thread feed in auxiliary assembly 600. Track 200 can have a hole in the center for winding on long objects. Also, mechanical failure can be avoided by circulating new cars 250 into the braiding area while reconditioning other cars 250, without any noticeable down-time.

In additional embodiments of the method of composite fiber braiding, a cylindrical or substantially-annular topography can be used for the surface-dimensional track to offer even greater advantage for complex thread windings. A work piece may be positioned inside the cylinder and cars 250 can wrap fibers from two-hemispheres of direction. To wind across the north and south poles, the work piece may be rotated and/or cars 250 can have thread feeds that articulate in the radius direction of the substantially annular surface-dimensional track. In particular work pieces with sphere-like geometry or other complicated geometries, such as pressure tanks, junction points, etc. material can be wound in accordance with the desired thread paths.

Example 4

Electrical Windings

Many electrical components including generators, motors, and transformers, use electrical windings. For these components to work, the location of the coils is essential because the magnetic fields dissipate rapidly over very short distances. Compromises between manufacturing cost and product quality are often made in the prior art. However, with the winding capabilities of the surface-dimensional track system 100, electrical component designs can be modified for better performance. Embodiments of surface-dimensional track system can be used in a method of winding electrical wires.

Example 5

Material Handling on Production Lines

Surface-dimensional track system 100 can be used in a method of transporting materials. Surface-dimensional track system 100 turns the production line into a production plane. A factory that hangs cars 250 from a track 200 on its ceiling could use cars 250 to carry parts through the production process. The remote control system or other central computer may maintain a full inventory of the parts and the location of the parts. In case of a back-up in the production process or a machine malfunctions, the remote control system can reroute the parts to another available machine. Likewise, for operations that are not sequential, management software can coordinate movement and processing to fully utilize the available machinery.

Several assembly lines could be running simultaneously on the same machines. For example, if several parts from different jobs need to be spray-painted, cars 250 can carry parts to the paint booth and then, after painting, un-collate the parts back into their respective production lines. This makes spray-painting more efficient, without having to change colors or re-tool for each different type in a single production line. Rush jobs can easily be accelerated ahead. Once entered into the remote control system, the material handling of an entire assembly line could be set-up or taken down with the push of a button. By interweaving various production lines one could maximize run-time percent while minimizing re-tooling and set-up time.

Robots on the floor could perform material handling, but the dangers of collision into crates, fork lifts, and people makes robots undesirable. Once installed in a factory, surface-dimensional track system 100 offers unmatched versatility and safety. For economy, track 200 could be wide in work areas and narrow in corridors. Each part or bin of parts is tagged and located and can be independently controlled to move in any direction across the factory floor. Software scheduling algorithms are enabled to maximize production beyond the linear constraints of the traditional assembly line.

Production facilities often keep low or zero inventory of products they have manufactured, and devote full energy and space to producing pending customer orders. Customers may order a diverse range of products requiring the factory to retool operations for intermittent batch runs. Breaking down and laying assembly lines of the prior art is costly. However, a factory might use a ceiling-mounted embodiment (or other embodiment) of track 200 with cars 250 having auxiliary assemblies 600 including hooks or part baskets for assembly-line conveyance. Changing assembly lines would simply require changing software at a remote control system sending two-dimensional velocity vectors to receiver assembly 700 of each car 250. Running multiple cars 250 simultaneously, advancing rush jobs, rerouting for oversized queues and down machinery, and accommodating for exceptional parts are just a few of the contemplated application of this versatile method of using a surface-dimensional track system in a material handling system.

By way of non-limiting example, the method of using surface-dimensional track system 100 in an assembly line can be used to assemble components of a jet or other similar vehicle or large equipment. It is contemplated that large components of the jet could be supported by cables in a hanger. The cables may hang from cars 250 as part of auxiliary assembly 600 having winches. Cars 250 are preferably in mechanical communication with an embodiment of track 200 characterized as a ceiling track. Using cable tripods would be very rigid, and give precise control of position. The wings may be assembled under correct deflection, and by moving all of cars 250 supporting a wing or other component simultaneously, the components of the wing may be moved with no stress to the next location for assembly. Hand held controls would provide the detailed positioning of the components to fasten them.

Example 6

Material Retrieval System

Surface-dimensional track system 100 may be used in a method of retrieving material. A large shelving system is positioned as if against a wall. Track 200 is preferably vertically-oriented so that multiple cars 250 can be used to simultaneously collect multiple materials. Any of the various steps of the method of using surface-dimensional track system 100 to retrieve material may also be combined with any of the various steps of the method of transporting materials.

While it is possible to have gantry cranes sharing the same outer wall track, gantry cranes cannot pass each other. In some applications, surface-dimensional track system 100 mounted on the ceiling may serve as a light-weight gantry cranes to greatly accelerate material handling. Not only does this automate the forklift operation, but it eliminates the space needed for forklift lanes. For instance, crates on a vast warehouse floor including track 200 could be accessed independently and delivered to individual truck bays. Support columns and other architectural geometry of the warehouse, while impossible to work around with gantry cranes, present almost no inconvenience for surface-dimensional track system 100.

Shelving isles or arrays may extend horizontally and vertically and there may be many isles of shelving. In a preferred method of using surface-dimensional track system 100, toothed surfaces 215 of T-rails 205 form vertical planes facing each isle of the shelving. Multiple cars 250 may run simultaneously within each isle in response to instructions from a remote control system. The method may also use additional tracks 200 having a plurality of surface-dimensional track to connect paths through the many isles of shelving. Each individual car 250 may preferably access any bin in any of the multiple rows of shelving.

Example 7

Complex Tooling

Virtually any process such as cutting, milling, drilling, soldering, painting, assembling, gluing, etc. can be advantageously computer controlled by methods using embodiments of surface-dimensional track system 100. Commonly, worm gears, hydraulics, and other systems move or rotate parts and/or tools, providing three, four, or more parameters of motion. Unless specially designed for a particular operation or part, standard machines use one tool and one part at a time, with relative positions usually controlled by up to six parameters. Standard components used for these processes may be included in auxiliary assembly 600 to be controlled by the remote control system (or an on-board electronic controller).

Auxiliary assembly 600 may also include computer numerical control ("CNC") accessories, such as in a brazing operation, using surface-dimensional track system 100. In preferred embodiments of a brazing method, track 200 may be as little as two feet by three feet and auxiliary assembly 600 of each of a plurality of cars 250 can include clamps. Various clamping arrangements are needed for the different payload or part types from potentially multiple production lines, and this is preferably accomplished either through setting angles and stops on the clamps for each part type or by including CNC accessories in auxiliary assembly 600 to rotate and position the clamps. In either case, at least three cars 250 with clamps are preferred for each part type.

A desired CNC program is loaded, preferably at remote control system, for each of the particular applications of surface-dimensional track system 100. The parts of the tool to be assembled are loaded into the clamps from an in-flow conveyor, for example. Cars 250 advance across track 200 and position to join parts in the brazing area. CNC brazing is then performed. The cars holding the parts move in unison, carry the piece to the out-flow conveyor, release the assembly, and re-circulate to the in-flow conveyor.

Using surface-dimensional track system 100 as a CNC-based assembling mechanism is extremely universal/modular and adapts to parts of various sizes and shapes by loading software without mechanical reconstruction of track 200 being necessary. By using multiple cars 250 for the same part, the clamps can be loaded and queued up in advance, accelerating the brazing operation to almost a continuous process, with cars 250 easily re-circulating to load new parts. By maintaining an inventory of cars 250 with various clamp configurations, retooling for other pieces from other production lines occurs instantly. Moreover, by having multiple conveyor in-flow and out-flow areas, multiple production lines can be funneled through the same brazing machine concurrently. For complicated assembly operations one could mount tools and/or parts on cars 250 and use two tracks 200 facing one another.

Figure 8A:
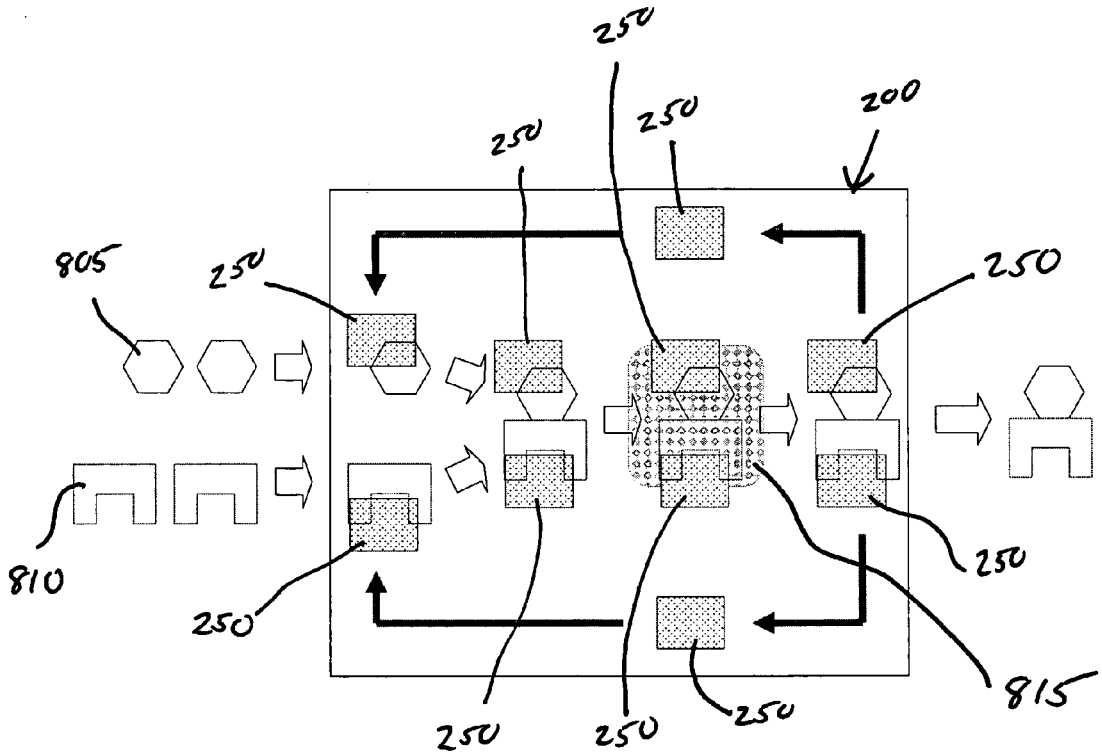
FIG. 8*a* is a flow diagram showing another method of using the surface-dimensional track system.
Figure 8B:
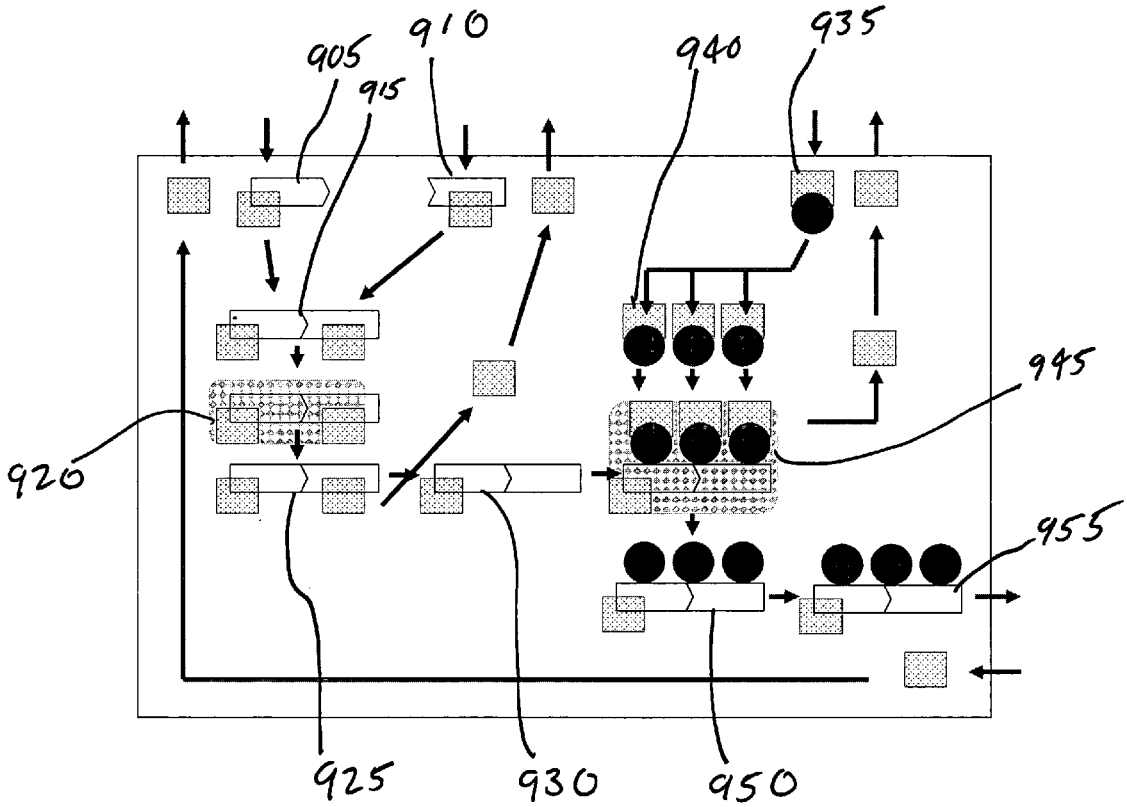
FIG. 8*b* is a flow diagram showing another embodiment of the method of using the surface-dimensional track system shown in FIG. 8*a*.

By way of non-limiting example, FIGS. 8*a* and 8*b* illustrate methods of using virtual track system 100 in a brazing or an assembly line context. For example, as shown in FIG. 8*a*, independent cars 250 may move a first component 805 and a second component 810 from separate lines to be secured to one another at processing machine 815, which is for brazing. In some embodiments, processing machine 815 may be used for riveting, screwing, cutting, injection molding, etc. One or both of cars 250 may then deposit the combined assembly and proceed to the beginning of the production line.

FIG. 8*b* illustrates another embodiment of using virtual track system 100 in a brazing or assembly line context. At step 905, car 250 picks up a component. At step 910, an additional car 250 picks up an additional component. At step 915, the two cars 250 carry the component and additional component, respectively, towards a processing machine, which is preferably be used for brazing, riveting, screwing, cutting, injection molding, etc. At step 920, the processing machine creates a combined part from the component and the additional component. At step 925, the combined part is carried from the processing machine by the two cars and, at step 930, one of the two cars 250 is recycled into the assembly line process, while the other carries the combined part towards an additional processing machine, which is preferably for brazing, but may be for any process, such as tooling, riveting, screwing, cutting, etc. At step 935 and step 940, a plurality of cars 250 pick-up and carry other components to the additional processing machine. At step 945, the additional processing machine processes the combined part and the other components into a processed assembly. At step 950, a single car 250 removes the processed assembly from the additional processing machine and, at step 955, carries the processed assembly to the next location on the assembly line, if any. FIG. 8*b* is a sample embodiment of a method of using surface-dimensional track system 100 in an assembly line. Parts may come from two or more production lines or bins and may be fixed together, brazed, mechanically fastened, etc. The processing machines may operate simultaneously and continuously and could be utilized by various production lines.

Additional embodiments of surface-dimensional track system 100 and uses thereof are contemplated. For example, preferred embodiments of surface-dimensional track system 100 can be conceptualized as having a car with an first motion system, a second motion system and a engagement system for mechanically securing the car to the track. In the preferred embodiment shown in FIG. 1, utilizing overlap between the first motion system and the engagement system by including both within first driving assembly 300. However, it is not required that the engagement structure and the first motion system be combined. Depending upon the embodiment of the invention, these three systems (engagement, first motion and second motion) may be embodied as three separate systems. There may also be any suitable combination or overlap.

As discussed above, preferred embodiments of surface-dimensional track system 100 include bearings (not shown) positioned between grippers 350 and T-rails 205 to minimize friction. However, motorized wheels may be used in place of the bearings to minimize friction between pinion 405 and toothed surfaces 215. These motorized wheels would thus, in some embodiments, further combine the first motion system, the second motion system, and the engagement system. In this example, the chain assembly can be characterized as an first motion system, the grippers can be characterized as a engagement system, and the motorized wheels can be characterized as the second motion system. It is also contemplated that a hydraulic spider can be used to traverse a grid of nodes, using multiple polar coordinates for its legs, where there is further overlap of the first motion system, the second motion system, and the engagement system.

In a warehouse or manufacturing facility, there is possibly an L-shaped floor space with various support columns extending from the floor to the ceiling. Here a gantry crane, boom crane, or any state of the art technology would not be able to access the total floor space efficiently with a unified overhead track system. An embodiment of the surface-dimensional track system accomplishes this stated need immediately, adapting to an L-shaped planar surface with holes representing the support columns. This is valuable in even a minimal applications consisting of one car, no electrified track, no motors, no x- or y-data, no central computer, no receiver, no pinions and no notches on the T-rails. A chain pull hanging below may be used for lifting loads and pulling the car around the room.

Embodiments of the present invention work in the above example in part because the cars footprint, that is where car is mounted to the track surface, follows the car and remains local to the car. Previously, cars with two dimensions of motion such as boom cranes, gantry cranes, xy-tables and robot arms, all require a clearance area extending to the periphery of the car motion. Prior track systems that allowed for cars to attach locally were linear track systems or linear track systems with branch points. Thus, the present invention has extended the scope of track systems with local car footprints from one dimension to two dimensions. A car held by gravity to the ground would accomplish the two dimensional motion with local footprint, but it is not mechanically fastened, lacks the stability of a tracks system, and not capable of accomplishing ceiling, vertical planar, or other disclosed applications. Thus, the motion flexibility of cars on the ground has been translated to a surface in any orientation, by rigidly and mechanical securing the car to the riding surface while allowing it to move in an unrestricted manner in any surface direction. Embodiments disclosed herein present a two-dimensional track surface, mechanical attachment to the track surface, and a local footprint of attachment that travels with the car.

Motorized CNC control found in the present invention offers organization of multiple parameters of control not found in prior systems. The two motion parameters of all the cars are parallel to the same surface, with crashing limits only when the cars occupy the same region of track. In this way, for N number of cars, 2*N variables of control can be coordinated to do countless tasks in an organized and direct operation. In a preferred embodiment of a planar track surface, the axis of motions are the orthogonal x and y directions for each of the cars and occupy the same region of the plane with no hidden collision limits. Furthermore with z-attachments, there may be 3N or more variables of motion in a common 3-dimensional space with no hidden collision limits on the variables. To achieve 3N variables of motion with robot arms in the same volume of 3-dimensional space without collisions would be difficult without adding significant constraints on the simultaneous motion of the cars. Even with one car, the local attachment to the surface permits car movement around stationary objects, such as the support columns in the L-shaped warehouse example, without effecting collisions. The advantages of this local footprint, free to move anywhere on a two dimensional track, grow rapidly with the increase in N.

This attribute provides many advantages in computer numeric control operations. The surface-dimensional track system allows for control of numerous highly organized and meaningful variables of motion simultaneously. Examples, include airplane assembly, material retrieval systems, pallet packing and sorting, material handling in distribution centers, flexible assembly lines for lean manufacturing, automated engagement and assembly tables, complex tooling, composite braiding, electrical coil winding, and many other applications.

Furthermore, a preferred embodiment shown in FIG. 3 demonstrates a practical implementation. In this embodiment, the car essentially may roll in either the x- or y-directions. These two movements are independent, thus enabling any trigonometric combination of velocities. The car comprises a gripper belt assembly and a pinion assembly that separately provide the x- and y-motion, respectively. The directional motion of the car may be separated into two rolling motions in the car. These separate rolling motions can be accomplished while remaining locally secured to the surface-dimensional track. Numerous alternative car and track designs become possible. For example, systems with belt assemblies providing motion in both x and y direction, with pinion assemblies providing motion in both x and y direction, using a periodic linear motion in the cars, or even mechanisms that separate the directional motion of the car into polar coordinates are enabled by the present invention.

Another embodiment of the surface-dimensional track system uses an array of nodes for the track and a spider design grippers on the car carriage for engaging the track. The nodes may be mushroom or doorknob shaped and are grabbing holds for the car, and may be arranged in any regular or irregular array describing the surface. Computer controller may be programmed with data regarding the location and spacing of the nodes. The car may have several legs. The leg motion may utilize any one of a variety of techniques, including rotating in circular motion and extending and contracting in length, as in polar coordinates. Each leg has a foot that clamps on the nodes when swung into position, and remains gripping the node with the motion of the car until the leg becomes fully extended. At this moment, the foot clamp releases the node, and the leg swings back to grab the oncoming nodes as know to the software. The nodes are preferable round to facilitate the swiveling of the gripping feet on them. This embodiment may be applied to surfaces of any curvature and any regular or irregular node distribution on the surface, preferably with the nodes close enough for at least three legs of the spider mechanism to be active clamping the nodes at all times. Electrical power may be transmitted from the track to the nodes by interspersing nodes as programmed in the computer in both polarities or by having rings on the trunk of the nodes for positive and negative terminals.

Preferred embodiments of the invention include a car for use with a track having a plurality of rails aligned to define a surface. The car preferably includes the following: (1) a car carriage for motion along the track in accordance with a two-dimensional velocity vector and a topography of the surface-dimensional track; (2) first driving assembly for mechanically securing the car carriage to the surface-dimensional track while inducing a motion component of the car carriage in accordance with the topography of the surface-dimensional track and an first component of the two-dimensional velocity vector; and (3) second driving assembly for inducing another motion component of the car carriage in accordance with the topography of the surface-dimensional track and a second component of the two-dimensional velocity vector. Preferred embodiments of the car further include receiving means for wirelessly receiving information representative of the first component of the two-dimensional velocity vector and the second component of the two-dimensional velocity vector. Some embodiments of the car include auxiliary assembly means for extension of apparatus from the car carriage, preferably in a "z" direction. Again, the references to "x", "y" and "z" are indicative of the local spatial orientation of the components of the car relative to one another and said references are not restrictive of the spatial orientation of the coordinate system with respect to absolutes or with respect to the relationship between the surroundings of the car. Auxiliary assembly means may also include other structures for many other purposes, depending upon the desired application (e.g. transporting parts, etc.).

Preferred embodiments of the invention also include a car for use with a track having a plurality of rails and a surface-dimensional track, the car comprising: (1) a car carriage for motion along the surface-dimensional track in accordance with a two-dimensional velocity vector and a topography of the surface-dimensional track; (2) a engagement system for mechanically securing the car carriage to a local portion of the track while allowing motion of the car carriage in accordance with the topography of the surface-dimensional track; (3) an first motion system secured to the car carriage for inducing a motion component of the car carriage in accordance with the topography of the surface-dimensional track and an first component of the two-dimensional velocity vector; and (4) a second motion system secured to the car carriage for inducing a motion component of the car carriage in accordance with the topography of the surface-dimensional track and an y-component of the two-dimensional velocity vector.

As used herein, the scope of the terms "first driving assembly means", "first driving assembly", "first motion system", "second driving assembly means", "second driving assembly", and/or "first motion system." do not necessarily require a motor means; some embodiments of the car may be unmotorized. Preferred embodiments of the invention may work passively a track engagement means, for example, by someone pulling on the car from the floor. Unlike a gantry crane or boom crane, such as those used in a garage, preferred embodiments of the car of the present invention mechanically engage the track locally, rather than the car being attached solely to a wall, for example. Thus, the footprint of the car preferably remains local to the car and the car is preferably attached to the track while the car can be moved in any direction or to any destination on the surface-dimensional track. In some embodiments of the invention, no motor, no pinion (and no electronic transmission of information) are needed.

Another example of "first driving assembly means", an "first driving assembly", "second driving assembly means", and/or a "second driving assembly" relates to a new type of engagement table. In this case, the cars may—or may not—be moved simultaneously. In use, the cars may be used in an at least temporary stationary arrangement, such as a track lighting system in a gallery or a versatile version of the multiple clamps or vises on slotted table in milling machines, or an extremely heavy thumbtack-bulletin board. The cars may or may not include a motor. In these and other embodiments of surface-dimensional track system, the cars may include brakes which would assist, for example, in instances where gravity would cause the cars to accidentally move. Thus, while preferred embodiments of the cars are adapted for movement in response to a computerized or manually-applied two-dimensional velocity vector, some embodiments of the cars may be at least temporarily stationary with respect to the track.

Preferred embodiments of the first driving assembly means include an first driving assembly secured to the car carriage. The first driving assembly preferably includes the following: (1) a plurality of sprockets; (2) a sprocket motor for rotating at least one of the plurality of sprockets in accordance with an first component of the two-dimensional velocity vector; (3) a chain assembly fitted about the plurality of sprockets in mechanical communication therewith; and (4) a plurality of grippers positioned along the length of the chain assembly, each one of the plurality of grippers being secured to the chain assembly and adapted for releasable attachment to one of the plurality of rails during rotation of the chain assembly about the plurality of sprockets. The second driving assembly means preferably includes a second driving assembly secured to the car carriage. The second driving assembly preferably includes a substantially cylindrical pinion and a pinion motor for rotating the substantially cylindrical pinion. Some embodiments of the invention do not require any pinions.

Preferred embodiments of the invention also include another car for use with a track having a plurality of rails and a surface-dimensional track. The car preferably includes a car carriage, an first driving assembly secured to the car carriage, and a second driving assembly secured to the car carriage. The car carriage is preferably for motion along the surface-dimensional track in accordance with a two-dimensional velocity vector and a topography of the surface-dimensional track.

The first driving assembly preferably includes the following: (1) a plurality of sprockets; (2) a sprocket motor for rotating at least one of the plurality of sprockets in accordance with an first component of the two-dimensional velocity vector; (3) a chain assembly fitted about the plurality of sprockets in mechanical communication therewith; and (4) a plurality of grippers positioned along the length of the chain assembly, each one of the plurality of grippers being secured to the chain assembly and adapted for releasable attachment to one of the plurality of rails during rotation of the chain assembly about the plurality of sprockets. Each one of the plurality of grippers are preferably secured to the chain assembly and each one of the plurality of grippers are preferably adapted for releasable attachment to one of the plurality of rails during rotation of the chain assembly. In some embodiments, each one of the plurality of grippers comprises a gripper positive terminal and a gripper negative terminal.

The second driving assembly of the car preferably includes a substantially cylindrical pinion positioned substantially perpendicular to a sprocket shaft connecting the sprockets. The substantially cylindrical pinion preferably has pinion teeth substantially parallel to a central axis of the pinion. The second driving assembly preferably also includes a pinion motor for rotating the substantially cylindrical pinion in accordance with a second component of the two-dimensional velocity vector. Preferred embodiments of the car also include receiving means, such as a wireless receiver, for wirelessly receiving information representative of the first component of the two-dimensional velocity vector and the second component of the two-dimensional velocity vector.

Preferred embodiments of the invention also include a track. The preferred track includes a plurality of rails and each one of the plurality of rails preferably include a toothed surface and a gripping surface set. Each one of the plurality of toothed surfaces are preferably positioned substantially parallel to each other. The plurality of rails preferably comprises at least four rails and, more preferably, comprise the minimal number of rails necessary so that two cars can pass one another on the track when the cars are going in opposite directions. Embodiments of the track include at least one sensor for sensing a location of at least one car operatively connected to the track, however, the sensor is more preferably part of the car. Furthermore, in some embodiments of the track, each set of the plurality of gripping surface sets comprises at least a positive electrical point and a negative electrical point.

The teeth of the toothed surface are preferably transversely positioned with respect to the rail. The plurality of toothed surfaces, collectively form a surface-dimensional track. In some embodiments of the track, the plurality of toothed surfaces form a planar surface-dimensional track. In some embodiments of the track, the toothed surfaces form a non-planar surface-dimensional track. In some embodiments of the track, the plurality of toothed surfaces form a substantially annular surface-dimensional track and, in some embodiments, the plurality of toothed surfaces face inside the substantially annular surface-dimensional track.

Any suitable topography for the surface-dimensional track may be used. The chosen topography for the surface-dimensional track may depend, at least in part, upon the chosen method of use and/or industrial application for the track. As disclosed herein, the cars may be upside-down, sideways, or in any other orientation with respect to a floor.

Each of the plurality of rails are preferably a T-rail having a head section and a corresponding carriage section. The head sections preferably include a toothed surface facing in a direction away from the carriage section attached to the head section. Each of the carriage sections preferably include at least one gripping surface set. Each gripping surface in the gripping surface set is preferably parallel with each other gripping surface in the set. Each of the plurality of rails may comprise an I-rail.

Preferred embodiments of the invention also include a surface-dimensional track system. The surface-dimensional track system preferably includes a track having a plurality of rails. Each of the rails preferably include a toothed surface and a gripping surface set. Each of the toothed surfaces are preferably positioned substantially parallel to each other one of the plurality of toothed surfaces. The plurality of toothed surfaces preferably form a surface-dimensional track. The toothed surfaces are not requirements and may be positioned in a different location, in embodiments of the invention where, respectively, the pinion is not used or the positioned is placed somewhere else.

The surface-dimensional track system preferably also includes at least one car and, more preferably, includes a plurality of cars. Each of the cars preferably include a car carriage for motion along the surface-dimensional track in accordance with a two-dimensional velocity vector and a topography of the surface-dimensional track. Each of the cars preferably also include first driving assembly means for securing the car carriage to the track while inducing a motion component of the car carriage in accordance with the topography of the surface-dimensional track and an first component of the two-dimensional velocity vector. Each of the cars preferably also include second driving assembly means for inducing another motion component of the car carriage in accordance with the topography of the surface-dimensional track and a second component of the two-dimensional velocity vector.

In some embodiments of the surface-dimensional track system, each of the cars further comprise receiving means for wirelessly receiving information representative of the first component of the two-dimensional velocity vector and the second component of the two-dimensional velocity vector. In some embodiments of the surface-dimensional track system, each of the receiving means are in electrical communication with the first driving assembly means and second driving assembly means of the corresponding one of the plurality of cars. Preferred embodiments of the surface-dimensional track system include a remote control system that wirelessly transmits to the receiving means either (i) the two-dimensional velocity vector corresponding to the receiving car and/or (ii) the first component and the second component of the two-dimensional velocity corresponding to the receiving car. Preferred embodiments of the surface-dimensional track system include auxiliary assembly means. For example, this may include an auxiliary motor and at least one of a winch, a bobbin, a robot arm, and a coiling spool.

Preferred embodiments of the remote control system include a computer-readable medium having computer-executable instructions stored thereon for performing a method and at least one computing device for executing the computer-executable instructions. Preferred embodiments of the computer-executable instructions include instructions for providing a current position of each of the cars and providing a desired destination of each of cars. The computer-executable instructions are preferably also for deriving avoidance paths from the current positions and desired destinations and deriving the two-dimensional velocity vectors from the topography of the surface-dimensional track and the avoidance paths. In some embodiments of the remote control system, the computer-executable instructions are also for deriving the first component and second component from each two-dimensional velocity vector. Preferred embodiments of the remote control system includes avoidance software and optimal routing algorithms. Some embodiments of the invention include optical or mechanical indexing of the exact location of each car.

Preferred embodiments of computer-readable medium further include computer-executable instructions stored thereon for deriving additional two-dimensional velocity vectors from the topography of the surface-dimensional track and the plurality of avoidance paths, each of the additional two-dimensional velocity vectors corresponding to one of the plurality of cars. In preferred embodiments of the surface-dimensional track system, the first driving assembly means and second driving assembly means of each car induce motion corresponding to the additional two-dimensional velocity vector after inducing motion corresponding to the two-dimensional velocity vector.

Each car may include individual electronic controllers that operate independently from one another and communicate with one another via a transceiver assembly. The electronic controller may be used in addition to the remote control system, such as when the remote control system is used to transmit simple instructions. In this respect, processing can occur at each car independently and varying instructions, depending on the particular application of surface-dimensional track system 100, can be transmitted from a central computer, such as a remote control system. In some embodiments of the invention, the remote control system is not required. In some embodiments of the invention, the remote control system can send high level instructions such as destination data or choices from a list of predefined routes. Furthermore, in some embodiments of the invention, each car may be controlled independently with a control box hanging from a cord from each car for individual human operation. In some embodiments of the invention, contact strips on the rails can be used to communicate information to each car from a central computer system for communication by wires.

As discussed above, some embodiments of the track include at least one sensor for sensing a location of at least one car operatively connected to the track. However, in other preferred embodiments of the invention, the motors, such as the sprocket motor, the pinion motor, and/or another motor, can comprise a stepper motor, which counts the angular turn during corresponding motion. The angular turn information may then be communicated to the electronic controller and/or the computer system. In some embodiments of the invention, the rails have an optical coding such as a notching or a bar code, and the cars have the sensors that read the track to determine the position of the cars. Thus, the surface-dimensional track system does not require that sensors are attached thereto. In some embodiments of the invention, the actual location of the car is preferably known by the car and transmitted to the central computer.

Preferred embodiments of the invention also include a method of using a surface-dimensional track system to braid fiber about a braiding target. The method preferably includes: (1) providing the braiding target; (2) providing a track having a plurality of rails having substantially parallel toothed surfaces that form a surface-dimensional track facing the braiding target; (3) providing a car carriage for motion along the surface-dimensional track in accordance with a plurality of two-dimensional velocity vectors and a topography of the surface-dimensional track; (4) providing a bobbin having fiber secured to the car carriage; (5) providing an first driving assembly for mechanically securing the car carriage to the track while inducing a motion component of the car carriage in accordance with the topography of the surface-dimensional track and first components of the plurality of two-dimensional velocity vector; (6) providing a second driving assembly for inducing another motion component of the car carriage in accordance with the topography of the surface-dimensional track and second components of the two dimensional velocity vectors; (7) providing a receiver assembly secured to the car carriage for receiving the plurality of two-dimensional velocity vectors or other locational information from a remote control system; (8) securing an end of the fiber to the braiding target; (9) providing the plurality of two-dimensional velocity vector in accordance with a desired path of the car carriage along the surface-dimensional track; (10) providing auxiliary instructions for controlling the bobbin; and (11) transmitting the plurality of two-dimensional velocity vectors and auxiliary instructions to the receiver assembly to cause the motion of the car carriage about the braiding target and to control the bobbin so as to braid fiber about the braiding target. In some applications, each car may have a computer controller, also referenced herein as an electronic controller and software with the programmed motion for the car. The use of numbers herein, such as "(1)", "(2)", and "(3)" above, is not to indicate a required order of steps but is for the purposes of clarity only. Preferred embodiments of the method of using a surface-dimensional track system to braid fiber about a braiding target may include any suitable combination of the steps.

Preferred embodiments of the invention also include a method a method of using a surface-dimensional track system to wind coiling material about a coiling target. The method preferably comprises: (1) providing the coiling target; (2) providing a track having a plurality of rails having substantially parallel toothed surfaces that form a surface-dimensional track facing the coiling target; (3) providing a car carriage for motion of the car carriage along the surface-dimensional track in accordance with a plurality of two-dimensional velocity vectors and a topography of the surface-dimensional track; (4) providing a coiling spool secured to the first car carriage and having coiling material wrapped thereabout; (5) providing an first driving assembly for mechanically securing the car carriage to the track while inducing a motion component of the car carriage in accordance with the topography of the surface-dimensional track and first components of the plurality of two-dimensional velocity vectors; (6) providing a second driving assembly for inducing another motion component of the car carriage in accordance with the topography of the surface-dimensional track and second components of the plurality of two-dimensional velocity vectors; (7) providing a receiver assembly secured to the car carriage for receiving the plurality of two-dimensional velocity vectors from a remote control system; (8) securing an end of the coiling material to the coiling target; (9) providing the two-dimensional velocity vectors in accordance with a desired path of the car carriage along the surface-dimensional track; (10) providing auxiliary instructions for controlling the coiling spool; and (11) transmitting the plurality of two-dimensional velocity vectors and auxiliary instructions to the receiver assembly to cause the motion of the car carriage about the coiling target and to control the coiling spool so as to wrap the coiling material about the coiling target. In some applications, each car may have a computer controller and software with the programmed motion of the car. Preferred embodiments of the method of using a surface-dimensional track system to wind coiling material about a coiling target may include any suitable combination of the steps.

Preferred embodiments of the invention also include a method of using a surface-dimensional track system. The method preferably includes providing a track having a plurality of rails having substantially parallel toothed surfaces that form a surface-dimensional track facing the coiling target. The method preferably also includes providing a plurality of cars, each of the plurality of cars having: (i) car carriage; (ii) an first driving assembly for mechanically securing the car carriage to the track while inducing a motion component of the car carriage in accordance with the topography of the surface-dimensional track and first components of the navigational instructions; (iii) a second driving assembly for inducing another motion component of the car carriage in accordance with the topography of the surface-dimensional track and second components of the navigational instructions; (iv) an auxiliary assembly secured to the car carriage; and (v) a receiver assembly secured to the car carriage for wirelessly receiving auxiliary instructions to control the auxiliary assembly. Preferred embodiments of the method of using a surface-dimensional track system also include developing the navigational instructions and auxiliary instructions in accordance with a desired assembly line process. In some embodiments, the method also includes wirelessly transmitting the navigational instructions to each of the plurality of cars to induce each of the plurality of cars to travel along the surface-dimensional track toward a corresponding one of a plurality of components, lift the corresponding one of a plurality of components with the auxiliary assembly, and transport the plurality of components along the surface-dimensional track to a new destination.

Although there has been hereinabove described a surface-dimensional track system and other related systems, methods and devices, for the purposes of illustrating the manner in which the invention may be used to advantage, it should be appreciated that the invention is not limited thereto. Accordingly, any and all modifications, variations, or equivalent arrangements which may occur to one skilled in the art should be considered to be within the scope of the present invention as defined in the appended claims.

What is claimed is:

1. A method of using a surface-dimensional track system to braid fiber about a braiding target, comprising:

providing the braiding target;

providing a track having a plurality of generally parallel rails having surfaces that define a surface-dimensional track;

providing a car carriage for motion along the surface-dimensional track in accordance with a plurality of two-dimensional velocity vectors and a topography of the surface-dimensional track, the car carriage comprising:

an engaging mechanism for mechanically securing the car carriage to the track;

a first driving assembly for inducing a motion component of the car carriage in accordance with the topography of the surface-dimensional track and first components of the plurality of two-dimensional velocity vector; and a second driving assembly for inducing another motion component of the car carriage in accordance with the topography of the surface-dimensional track and second components of the two-dimensional velocity vectors;

providing a bobbin having fiber, the bobbin secured to the car carriage;

providing a receiver assembly secured to the car carriage for wirelessly receiving the plurality of two-dimensional velocity vectors from a remote control system;

securing an end of the fiber to the braiding target;

providing the plurality of two-dimensional velocity vectors in accordance with a desired path of the car carriage along the surface-dimensional track; and wirelessly transmitting the plurality of two-dimensional velocity vectors to the receiver assembly to cause the motion of the car carriage about the braiding target and to control the bobbin so as to braid fiber about the braiding target.

2. A method of using a surface-dimensional track system to wind coiling material about a coiling target, comprising:

providing the coiling target;

providing a track having a plurality of generally parallel rails that define a surface-dimensional track;

providing a car carriage for motion of the car carriage along the surface-dimensional track in accordance with a plurality of two-dimensional velocity vectors and a topography of the surface-dimensional track, the car carriage comprising:

an engaging mechanism for mechanically securing the car carriage to the track;

a first driving assembly for inducing a motion component of the car carriage in accordance with the topography of the surface-dimensional track and first components of the plurality of two-dimensional velocity vectors; and a second driving assembly for inducing another motion component of the car carriage in accordance with the topography of the surface-dimensional track and second components of the plurality of two-dimensional velocity vectors;

providing a coiling spool secured to the first car carriage and having coiling material wrapped thereabout;

providing a receiver assembly secured to the car carriage for wirelessly receiving the plurality of two-dimensional velocity vectors from a remote control system;

securing an end of the coiling material to the coiling target;

providing the two-dimensional velocity vectors in accordance with a desired path of the car carriage along the surface-dimensional track;

providing auxiliary instructions for controlling the coiling spool; and wirelessly transmitting the plurality of two-dimensional velocity vectors and auxiliary instructions to the receiver assembly to cause the motion of the car carriage about the coiling target and to control the coiling spool so as to wrap the coiling material about the coiling target.

3. A method of using a surface-dimensional track system, comprising:

providing a track having a plurality of substantially parallel rails that form a surface-dimensional track for supporting at least two simultaneous and independent dimensions of movement;

providing a plurality of cars, each of the plurality of cars having: (i) car carriage of a car for motion of the car carriage along the surface-dimensional track in accordance with a plurality of navigational instructions; (ii) a first driving assembly for inducing a first translation component for motion of the car carriage along the track in accordance with the navigational instructions; (iii) a second driving assembly for inducing simultaneously with the first driving assembly a second translation component for the motion of the car carriage along the track in accordance with the navigational instructions to induce the motion of the car carriage along the track that is a combination of the first translation component and the second translation component; (iv) an auxiliary assembly secured to the car carriage; (v) an engaging mechanism for mechanically securing the car carriage to the track; and (vi) a receiver assembly secured to the car carriage for receiving auxiliary instructions to control the auxiliary assembly;

developing the navigational instructions and auxiliary instructions in accordance with a component handling process; and wirelessly transmitting the navigational instructions to each of the plurality of cars to induce each of the plurality of cars to travel along the surface-dimensional track toward at least a corresponding component, engage the at least a component with the auxiliary assembly, and transport the at least a component along the surface-dimensional track to a new destination.

4. A surface-dimensional track system, comprising:

a track, comprising a plurality of generally parallel rails, the plurality of rails defining a track surface;

a plurality of cars movably secured to the rails and tangentially movable in at least two orthogonal directions along the track surface, each car comprising:

a receiver for receiving movement instructions for the respective car;

a first driving assembly for driving the car along a first direction with respect to the track surface;

a second driving assembly for driving the car along a second direction with respect to the track surface simultaneously with the first driving assembly so as to induce a motion of the car along the track that is a combination of the first direction and the second direction;

a controller for controlling the first and second driving assemblies according to the respective movement instructions; and an auxiliary system for performing a task with a component; and a remote control system for transmitting the respective movement instructions to the cars, the remote control system comprising:

a computer-readable medium having computer-executable instructions stored thereon for performing the following method:

determining a current position of each of the cars;

computing a desired destination for each of the cars according to the respective task with the respective component; and transmitting the desired destinations to the cars; and at least one computing device for executing the instructions on the computer-readable medium.

5. The surface-dimensional track system of claim 4, wherein the auxiliary system comprises at least one of a winch, a bobbin, a robot arm, a part carrier, or a coiling spool.

6. The surface-dimensional track system of claim 5, wherein the auxiliary system further comprises an auxiliary motor.

7. The surface-dimensional track system of claim 4, wherein the auxiliary system comprises a bobbin adapted for braiding a target, and the computer-executable instructions further comprise computing the desired destination of each car to control the respective bobbin so as to braid fiber about the target.

8. The surface-dimensional track of claim 7 wherein the track surface is substantially cylindrical or annular and surrounds the target.

9. The surface-dimensional track system of claim 7 wherein the computer-executable instructions further comprise:

computing auxiliary instructions for controlling each of the bobbins; and transmitting to the cars the auxiliary instructions.

10. The surface-dimensional track system of claim 4 wherein the computer-executable instructions further comprise:

causing a first car to cease working on the respective task; and causing a second car to begin working on the respective task of the first car; and avoidance software to prevent the first car from colliding with the second car.

11. The surface-dimensional track of claim 4 wherein the auxiliary system is adapted to carry the component, and the computer-executable instructions further comprise:

computing the desired destination of each car to cause each car to travel along the track surface to carry the corresponding component to a new destination.

12. The surface-dimensional track of claim 11, wherein the auxiliary system is adapted to releasably carry the respective component, each controller controlling the auxiliary system according to auxiliary instructions received from the respective receiver, and the computer-executable instructions further comprise:

computing the desired destinations of at least a first car and the auxiliary instructions of the first car to cause the first car to travel to a first location, engage a first component, and carry the first component to a second location; and transmitting the auxiliary instructions and the desired destinations to the first car.

13. The surface-dimensional track of claim 12, wherein the computer-executable instructions further comprise computing the desired destinations of the first car and the auxiliary instructions of the first car to cause the first car to release the first component at the second location.

14. The surface-dimensional track of claim 13, wherein the computer-executable instructions further comprise computing the desired destinations of a second car and the auxiliary instructions of the second car to cause the second car to travel to the first location, engage the first component, and travel with the first car to carry the first component to the second location.

15. The surface-dimensional track of claim 12, wherein the computer-executable instructions further comprise:

computing the desired destinations of at least a second car and the auxiliary instructions of the second car to cause the second car to travel to a third location, pick up a second component, and carry the second component to the second location; and transmitting the auxiliary instructions and the desired destinations to the second car;

wherein the first component and the second component are coupled to each other at the second location.

16. The surface-dimensional track of claim 4, wherein the receiver wirelessly receives the movement instructions for the respective car, and the desired destinations are wirelessly transmitted to the cars.

* * * * *